US006742703B2

(12) United States Patent
Esakov et al.

(10) Patent No.: US 6,742,703 B2
(45) Date of Patent: Jun. 1, 2004

(54) MAIL COLLECTION BOX

(75) Inventors: Michael D. Esakov, Inman, SC (US); Charles Kannankeril, North Caldwell, NJ (US); Lawrence J. Pillote, Southbury, CT (US); Atul Arora, Piscataway, NJ (US); William P. Roberts, Spartanburg, SC (US)

(73) Assignee: Sealed Air Corporation, Saddle Brook, NJ (US)

( * ) Notice: Subject to any disclaimer, the term of this patent is extended or adjusted under 35 U.S.C. 154(b) by 0 days.

(21) Appl. No.: 10/159,835

(22) Filed: May 31, 2002

(65) Prior Publication Data

US 2003/0222133 A1 Dec. 4, 2003

(51) Int. Cl.[7] ..... B65G 11/04
(52) U.S. Cl. ..... 232/45; 232/30
(58) Field of Search ..... 232/45, 30, 31, 232/32, 17, 43.2, 44; 220/495.06, 495.08, 495.11

(56) References Cited

U.S. PATENT DOCUMENTS

| | | | | | |
|---|---|---|---|---|---|
| 141,237 | A | * | 7/1873 | Ginesi | 232/32 |
| 244,227 | A | * | 7/1881 | Rosenstjerna | 232/32 |
| 336,052 | A | * | 2/1886 | Jovine | 232/32 |
| 358,632 | A | * | 3/1887 | Teller | 232/32 |
| 378,955 | A | * | 3/1888 | Dubey | 232/30 |
| 400,026 | A | * | 3/1889 | Wlcek | 232/32 |
| 458,273 | A | * | 8/1891 | Scott | 232/21 |
| 462,092 | A | * | 10/1891 | Downing | 232/30 |
| 464,275 | A | * | 12/1891 | Cummings | 232/17 |
| 564,109 | A | * | 7/1896 | Savorgnan | 232/32 |
| 572,893 | A | * | 12/1896 | Hentz | 232/30 |
| 597,437 | A | * | 1/1898 | Savorgnan | 232/32 |
| 718,717 | A | * | 1/1903 | Marx et al. | 232/32 |
| 787,476 | A | * | 4/1905 | Sheley | 232/31 |
| 811,611 | A | * | 2/1906 | Aresnault | 232/32 |
| 846,564 | A | * | 3/1907 | Hart | 232/32 |

(List continued on next page.)

FOREIGN PATENT DOCUMENTS

| | | | |
|---|---|---|---|
| JP | 7-215397 | * | 8/1995 |
| WO | 03/039982 A1 | | 5/2003 |

OTHER PUBLICATIONS

U.S. Postal Service, "Emergency Preparedness Plan for Protecting Postal Employees and Postal Customers from Exposure to Biohazardous Material . . . " Mar. 06, 2002 (including Appendices A–H).

*Primary Examiner*—William L. Miller
(74) *Attorney, Agent, or Firm*—Daniel B. Ruble

(57) ABSTRACT

A mail collection apparatus comprising a housing defining an access opening. An access door is supported by the housing. The access door is moveable between a door open position, providing access to the housing interior space through the access opening, and a door closed position blocking the access opening. A chute is supported by the housing. The chute comprises an inlet end defining a chute inlet opening adapted for receiving mail and a chute outlet end defining a chute outlet opening opposite the inlet end. A bag comprises an inlet portion defining a bag inlet opening. The bag and chute are moveable relative each other between: 1) a mail deposit mode, in which the chute and the bag cooperate to form an enclosed mail deposit pathway from the chute inlet opening to the bag inlet opening and adapted so that mail deposited through the chute inlet opening falls along the mail deposit pathway through the chute outlet opening and the bag inlet opening into the bag interior space, and 2) a mail collection mode, in which the chute and the bag are spaced apart from each other. The apparatus may be useful in helping to reduce exposure to contaminated mail that may be deposited in the apparatus.

29 Claims, 17 Drawing Sheets

U.S. PATENT DOCUMENTS

| | | | | | |
|---|---|---|---|---|---|
| 934,245 | A | * | 9/1909 | Viezzi | 232/32 |
| 1,027,524 | A | * | 5/1912 | Cook | 232/30 |
| 1,058,419 | A | * | 4/1913 | Frediani | 232/53 |
| 1,256,044 | A | * | 2/1918 | Schilling | 232/31 |
| 1,260,038 | A | | 3/1918 | Plank | |
| 1,451,343 | A | | 4/1923 | Panagopolous | |
| 1,550,597 | A | * | 8/1925 | Viezzi | 232/32 |
| 1,640,153 | A | * | 8/1927 | Kolstad | 232/19 |
| 1,838,801 | A | * | 12/1931 | Andrews et al. | 232/32 |
| 2,144,323 | A | | 1/1939 | Bienz | |
| 2,421,221 | A | | 5/1947 | Rothe | |
| 3,300,128 | A | * | 1/1967 | Jasinski et al. | 232/17 |
| 3,982,690 | A | | 9/1976 | Krizan et al. | |
| 4,069,965 | A | * | 1/1978 | Maddox, Jr. | 232/19 |
| 4,363,438 | A | | 12/1982 | Connor | |
| 4,776,512 | A | | 10/1988 | Moore et al. | |
| 4,886,164 | A | | 12/1989 | Stein et al. | |
| 4,929,261 | A | | 5/1990 | Jacobson | |
| 5,022,548 | A | | 6/1991 | Stakis | |
| 5,040,904 | A | | 8/1991 | Cornwell | |
| 5,097,950 | A | | 3/1992 | Weiss et al. | |
| 5,147,242 | A | | 9/1992 | Lowe, Jr. | |
| 5,174,468 | A | | 12/1992 | Holderman | |
| 5,181,628 | A | | 1/1993 | Okezie | |
| 5,185,126 | A | | 2/1993 | Adamski et al. | |
| 5,205,649 | A | | 4/1993 | Fullerton | |
| 5,232,274 | A | | 8/1993 | Johan et al. | |
| 5,255,492 | A | | 10/1993 | Larson | |
| 5,328,028 | A | | 7/1994 | Hale et al. | |
| 5,339,959 | A | | 8/1994 | Cornwell | |
| 5,368,226 | A | | 11/1994 | Franceschino | |
| 5,400,989 | A | | 3/1995 | Gaskill | |
| 5,404,999 | A | | 4/1995 | Bednar | |
| 5,411,193 | A | | 5/1995 | Culp | |
| 5,425,468 | A | | 6/1995 | Birkel et al. | |
| 5,482,208 | A | | 1/1996 | Johnston | |
| 5,511,657 | A | | 4/1996 | Gnau, III et al. | |
| 5,687,839 | A | | 11/1997 | Gnau, III et al. | |
| 5,718,168 | A | | 2/1998 | Harrington | |
| 5,807,230 | A | | 9/1998 | Argenta et al. | |
| 6,042,001 | A | | 3/2000 | Siler et al. | |
| 6,247,642 | B1 | | 6/2001 | Wilson, Jr. | |
| 2003/0106929 | A1 | * | 6/2003 | Day et al. | 232/30 |

* cited by examiner

MAIL COLLECTION BOX

BACKGROUND OF THE INVENTION

The present invention relates to mail collection boxes.

Mail such as letters, postcards, and parcels may be anonymously deposited into any one of the over 300,000 free-standing mail collection boxes located in the U.S. on streets and parking lots. U.S. Postal Service employees collect the deposited mail from these mail collection boxes on a regular basis. The collected mail is sent by truck to centralized facilities for processing and distribution.

Recently one or more terrorists have used the U.S. mail system to send anthrax, harming several Postal Service employees and customers. The anthrax mailing caused at least five deaths. It is believed that the letters carrying anthrax were initially deposited in mail collection boxes. In such a situation, a mail collector may be exposed to anthrax while collecting mail from the mail collection box that holds a contaminated letter. Mail that resides with the contaminated letter in the mail collection box—or that is later commingled with the contaminated letter during mail processing and distribution—may be cross-contaminated with anthrax, further spreading the risk of exposure.

SUMMARY OF THE INVENTION

The present invention addresses one or more of the aforementioned problems. A mail collection apparatus comprises a housing defining an access opening. An access door is supported by the housing. The access door is moveable between a door open position, providing access to the housing interior space through the access opening, and a door closed position blocking the access opening. A chute is supported by the housing. The chute comprises an inlet end defining a chute inlet opening adapted for receiving mail and a chute outlet end defining a chute outlet opening opposite the inlet end. A bag comprises an inlet portion defining a bag inlet opening. The bag and chute are moveable relative each other between: 1) a mail deposit mode, in which the chute and the bag cooperate to form an enclosed mail deposit pathway from the chute inlet opening to the bag inlet opening and adapted so that mail deposited through the chute inlet opening falls along the mail deposit pathway through the chute outlet opening and the bag inlet opening into the bag interior space, and 2) a mail collection mode, in which the chute and the bag are spaced apart from each other. The apparatus may be useful in helping to reduce exposure to contaminated mail that may be deposited in the apparatus.

These and other objects, advantages, and features of the invention will be more readily understood and appreciated by reference to the detailed description of the invention and the drawings.

DETAILED DESCRIPTION OF THE INVENTION

Figure 1:
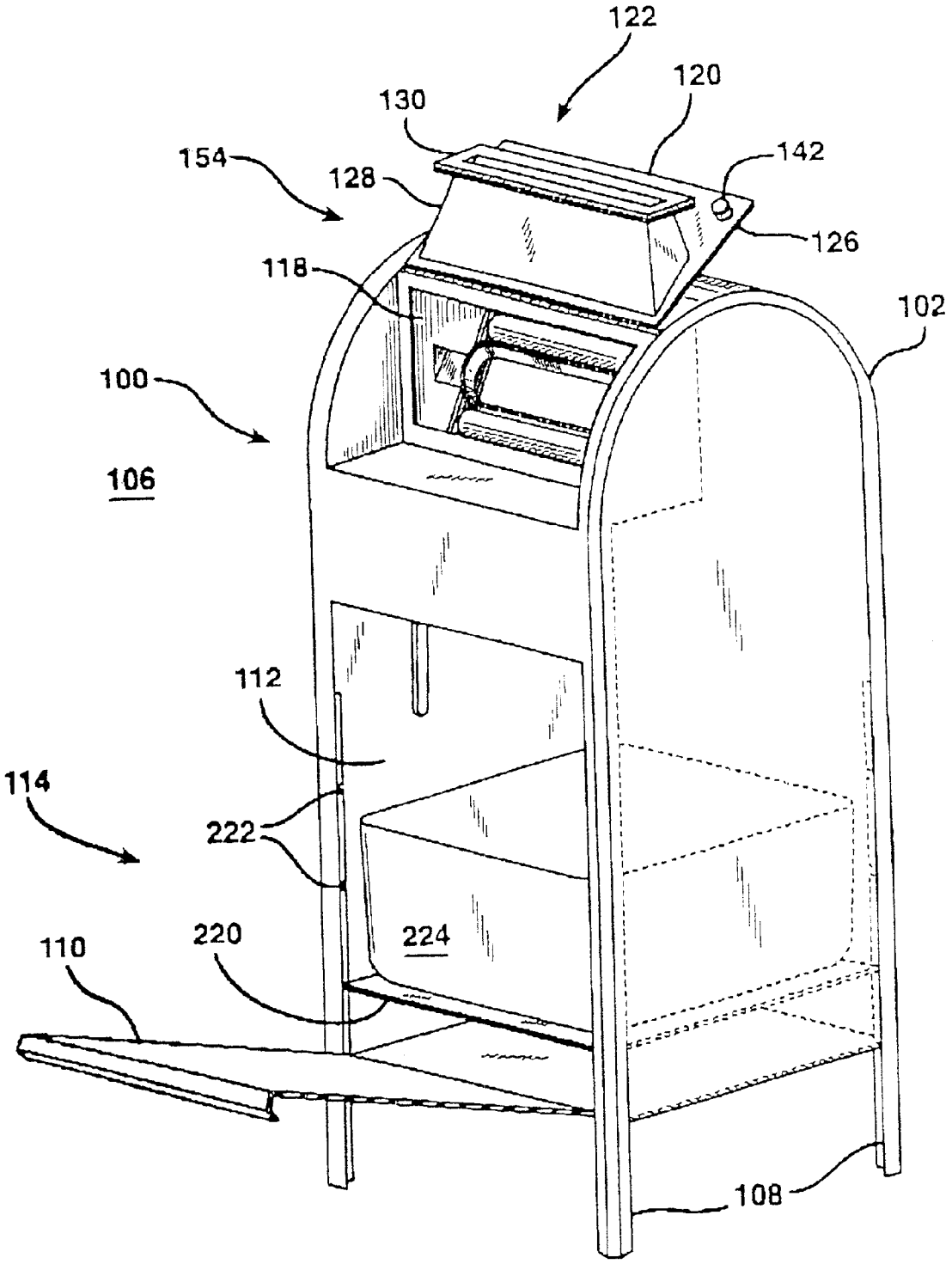
FIG. 1 is a perspective view of the mail collection box of the present invention.

A mail collection bag 10 (FIGS. 13–24) may be used to collect and secure mail 11 deposited in mail collection box 100 (FIGS. 1–12). The inventive mail collection bag and its related aspects are the subject matter of U.S. patent application Ser. No. 10/160,588 entitled "Mail Collection Bag" filed by the same inventors as the present application on the same day and owned by the same entity as the present application. That application is incorporated herein in its entirety by this reference.

Mail Collection Box

A mail collection bag 10 (FIGS. 13–24) may be used to collect and secure mail 11 deposited in mail collection box 100 (FIGS. 1–12). The inventive mail collection bag and its related aspects are the subject matter of U.S. patent application Ser. No. 10/160,588 filed May 31, 2002 entitled "Mail Collection Bag" filed by the same inventors as the present application and owned by the same entity as the present application. That application is incorporated herein in its entirety by this reference.

An access door 110 may be supported by housing 102, for example pivotally supported by one or more hinges mounted to housing 102, so that the access door is moveable from a door open position 114 (FIGS. 1, 4–5, 8), which provides access to the housing interior space 104 through access opening 112, and a door closed position 116 (FIG. 2), which blocks access to the housing interior space 104 through opening 112. A gasket (not shown) of similar type and arrangement as discussed below in conjunction with the deposit door 120 may be used with the access door, for example, to form a quality and type of seal the same as of any of the seals described below. An access door lock (not shown) may be provided that is adapted to lock the access door in the closed position. This lock may be of the same type and arrangement as the locking mechanism 142 discussed below.

A deposit door 120 may be supported by housing 102, for example pivotally supported by one or more hinges mounted to housing 102, so that the deposit door is moveable from a deposit door open position 122 (FIGS. 1, 4–5, 8), which provides access to the housing interior space 104 through mail deposit opening 118, and a deposit door closed position 124 (FIGS. 2–4), in which the perimeter 126 of deposit door 120 engages housing 102. Deposit door 120 may include a deposit opening gasket 176 proximate perimeter 126—and/or housing 102 may include deposit opening gasket 176 surrounding mail deposit opening 118—to facilitate a seal between the deposit door and the housing in the deposit door closed position 124. The quality and type of seal may be that of any of the seals described below. Deposit door locking mechanism 142 is positioned to interact between the deposit door 120 and housing 102 so that the deposit door 102 may be locked in the deposit door closed position 124. Portions of locking mechanism 142 may be mounted to housing 102, deposit door 120, or both. Suitable locking mechanisms are known in the art.

Figure 2:
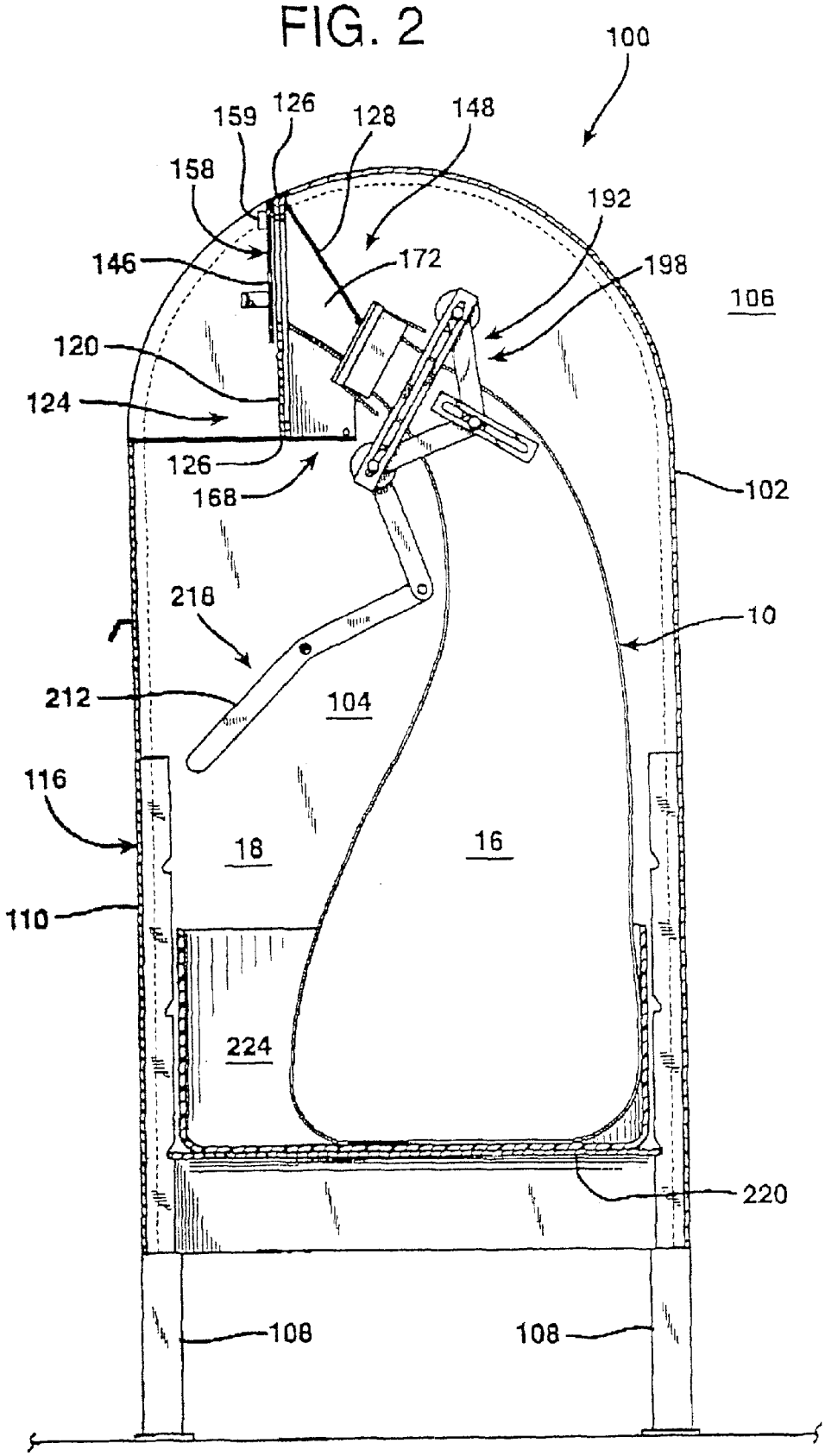
FIG. 2 is a representational side elevation sectional view of the mail collection box and the mail collection bag in the mail deposit mode.
Figure 7:
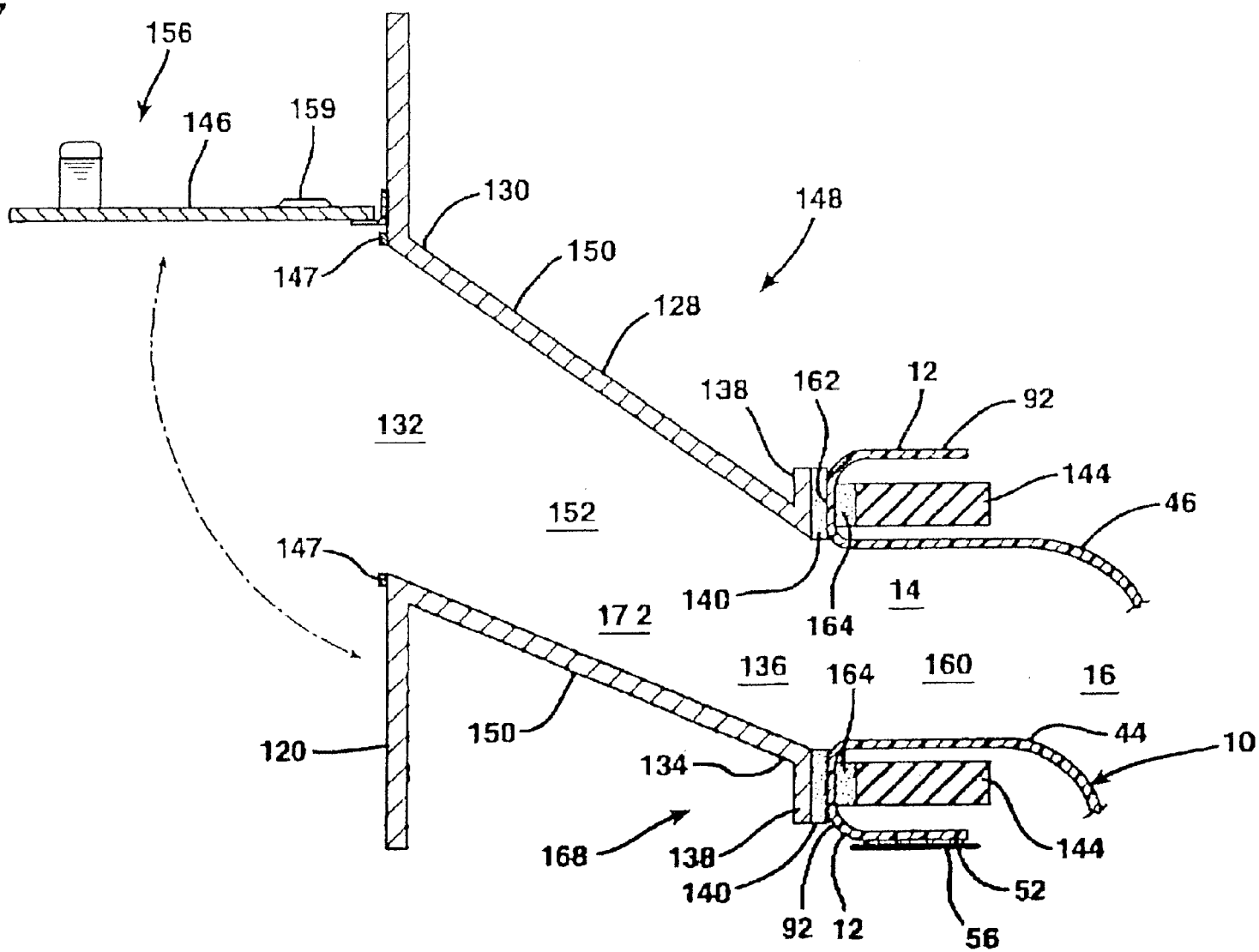
FIG. 7 is a representational fragmentary sectional view of the chute of the mail collection box and the mail collection bag in the mail deposit mode.

Chute 128 may be supported by housing 102, for example, by being supported by deposit door 120. (FIGS. 1–2, 7.) Chute 128 includes an inlet end 130 defining a chute inlet opening 132 adapted for receiving mail. (FIG. 7.) Chute 128 also includes an outlet end 134 defining a chute outlet opening 136 opposite the chute inlet end. Chute 128 defines chute pathway 152 from chute inlet opening 132 to chute outlet opening 136. Chute 128 may include one or more side walls 150 that may cooperate to provide an unapertured chute pathway 152 between the chute inlet and outlet openings. Chute 128 may be constructed of any suitable structural material, such as plastic or metal.

The outlet end 134 of chute 128 may include chute outlet flange 138 surrounding chute outlet opening 136. The outlet end 134 of chute 128 may also include chute outlet gasket 140 positioned on the surface of chute flange 138. Chute outlet gasket 140 may be adhesively or mechanically attached to chute flange 138. Chute outlet gasket 140 (and any gasket mentioned in the application) may be made of any suitable gasketing material, for example a resilient material such as an elastomer or foamed plastic.

Figure 4:
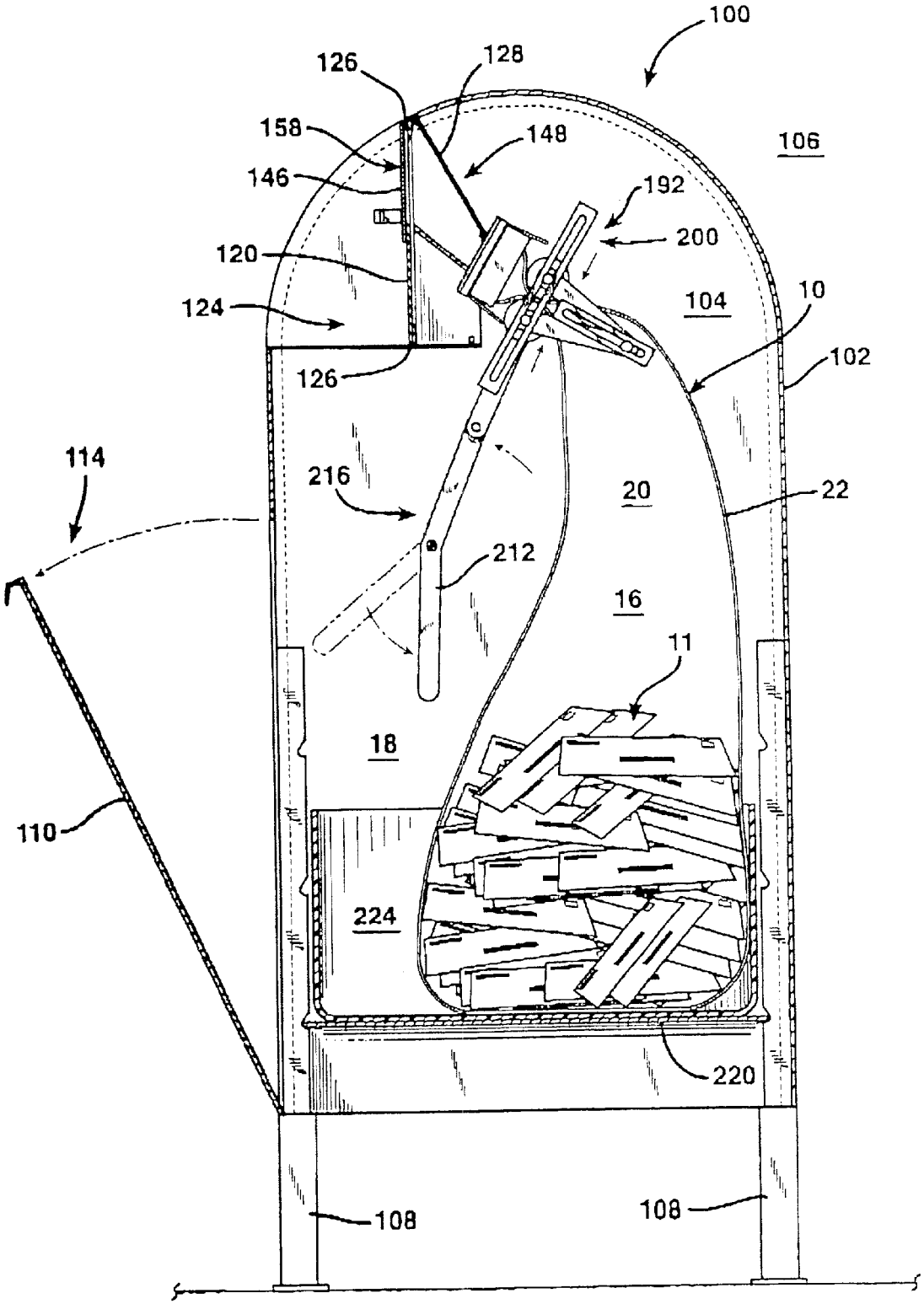
FIG. 4 is a representational side elevation sectional view of the mail collection box and the mail collection bag with the clamp in the clamp closed position.
Figure 5:
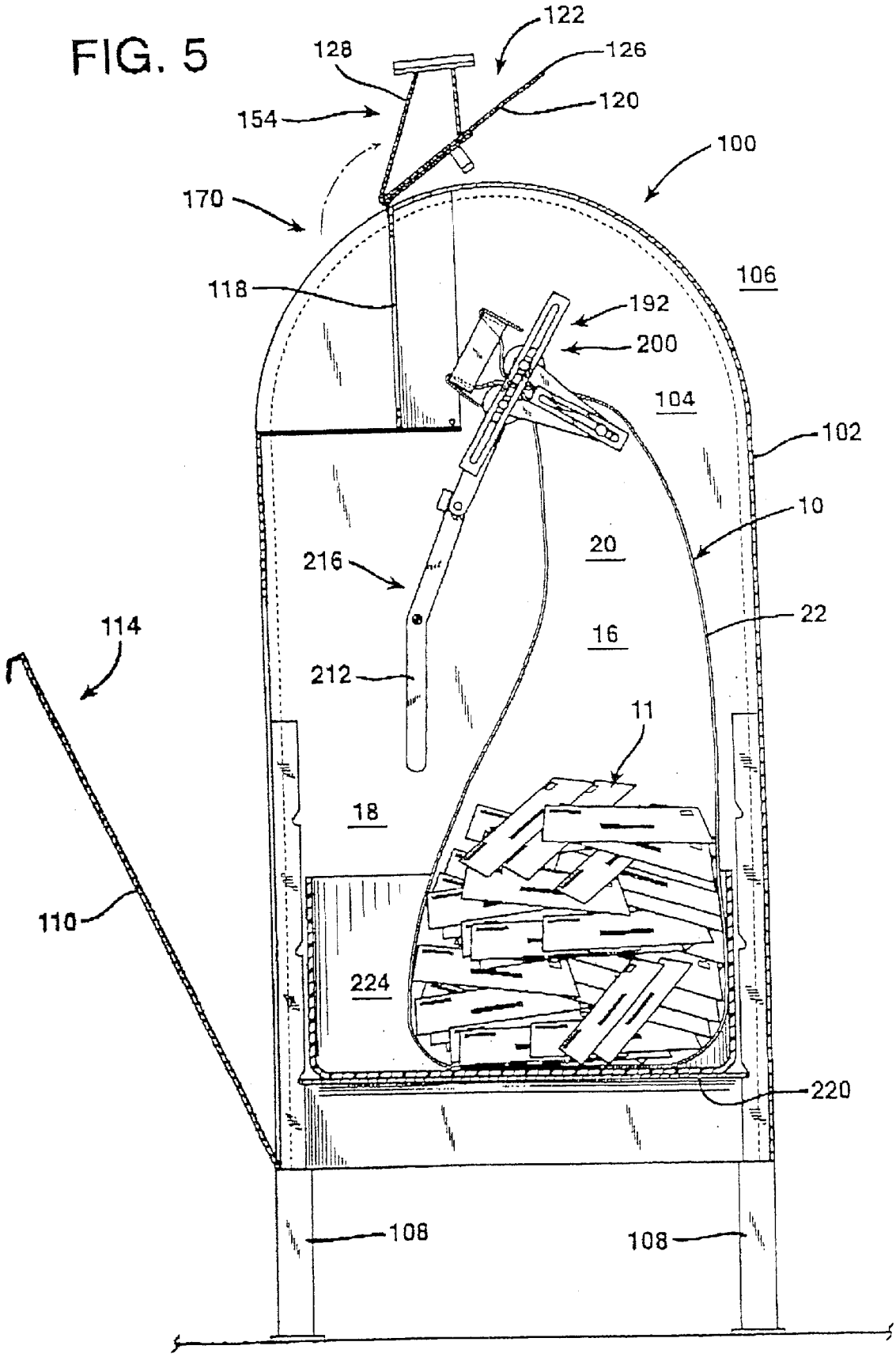
FIG. 5 is a representational side elevation sectional view of the mail collection box and the mail collection bag with the chute in the chute up position.
Figure 6:
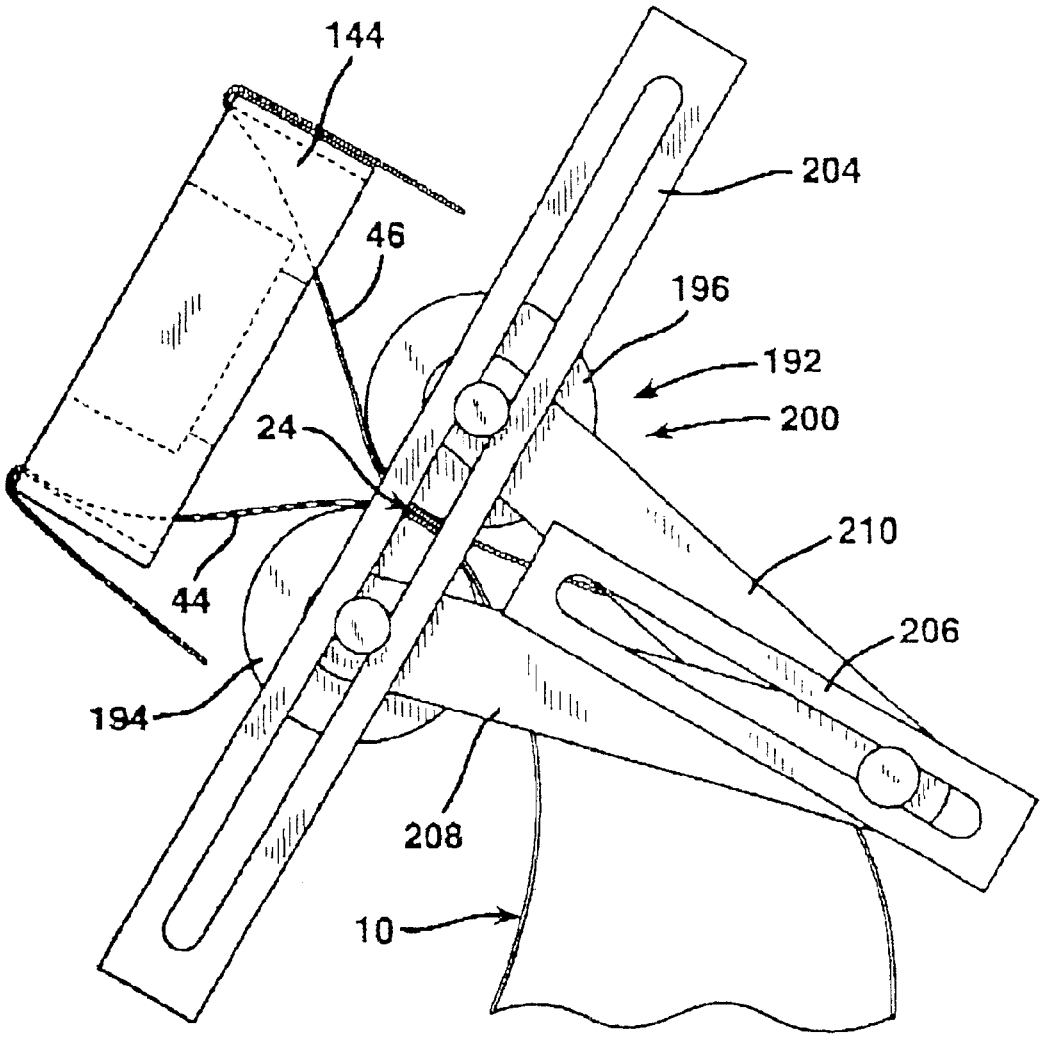
FIG. 6 is an expanded representational sectional view of a portion of the clamp of FIG. 5.
Figure 8:
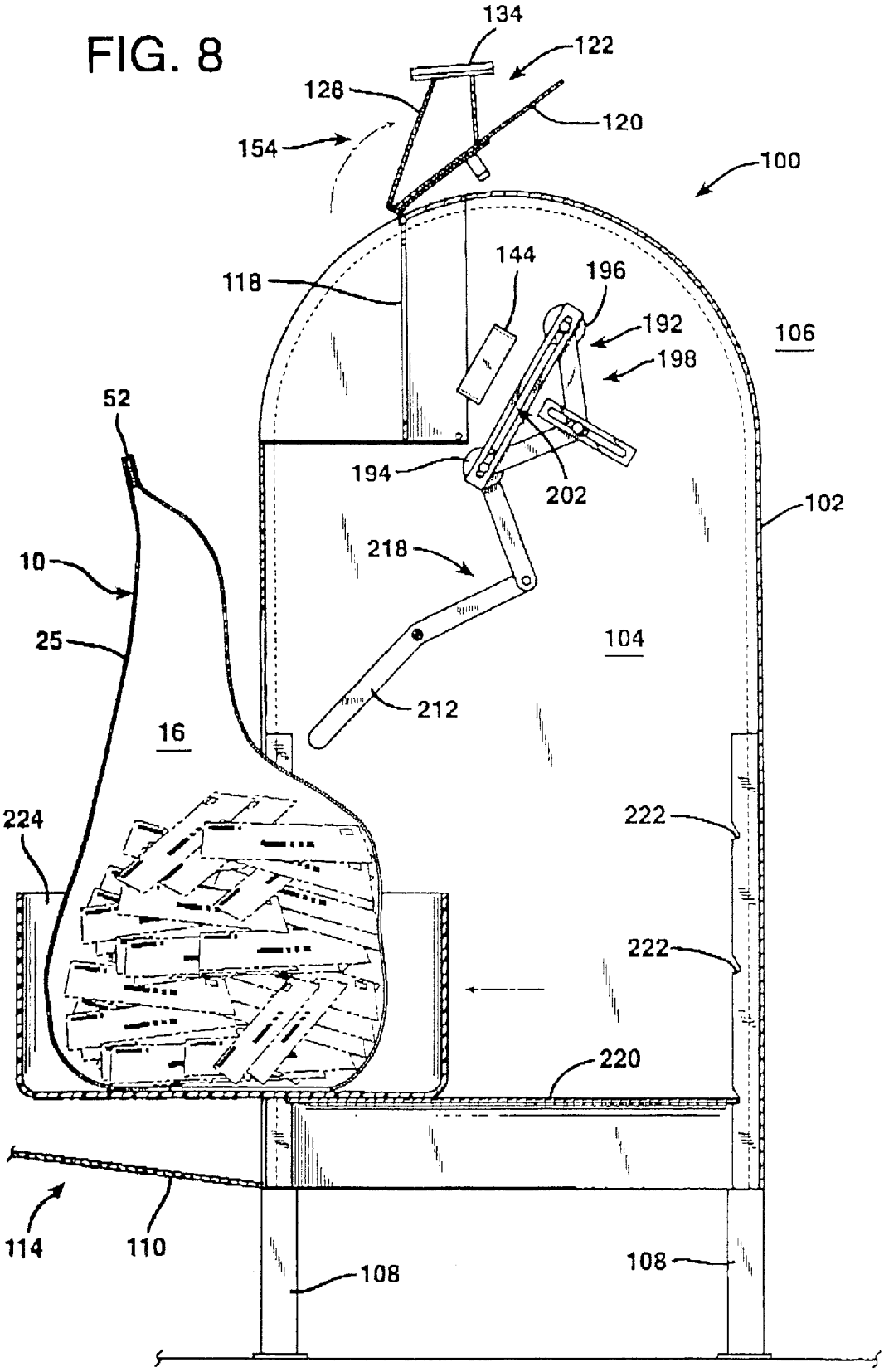
FIG. 8 is a representational side elevation sectional view of the mail collection box with the chute in the chute up position and the access door in the open position.

In a first embodiment, chute 128 may be moveably supported by the housing so that the chute is moveable between a chute down position 148 (FIGS. 2–4, 7) and a chute up position 154 (FIGS. 1, 5, 8). In the chute down position 148, chute outlet end 134 is positioned so that chute pathway 152 may provide an inclined surface for mail 11 deposited through chute inlet opening 132 to slide to chute outlet opening 136 and into housing interior space 104. In the chute up position 154, chute outlet end 134 is in housing exterior space 106.

In a second embodiment (FIGS. 11–12), chute 128 may be fixedly supported by housing 102, for example, supported other than by deposit door 120, and also for example fixedly supported by housing 102 in the equivalent of the chute down position 148 of the first embodiment. Deposit door 120 may include chute inlet gasket 174—and/or chute inlet end 130 may include chute inlet gasket 174—to facilitate a seal between the deposit door 120 and chute 128 in the deposit door closed position 124. The quality and type of this seal may be that of any of the seals described below.

Chute door 146 may be moveably supported by deposit door 120 (FIGS. 7, 11–12) or by chute 128 (not shown), for example, pivotally supported by one or more hinges mounted to deposit door 120 or to chute 128. Chute door 146 may be moved between a chute door open position 156 (FIGS. 7, 11–12), which allows access for mail 11 to be deposited through chute inlet opening 132, and chute door closed position 158 (FIGS. 2, 4), which blocks access to chute inlet opening 132.

Collar 144 may be supported by housing 102. (FIG. 7.) Collar 144 defines collar opening 160 and includes collar inlet surface 162. Collar 144 may include collar gasket 164 positioned on collar inlet surface 162, for example, adhesively or mechanically attached to collar inlet surface 162. Collar gasket 164 may be made of any suitable gasketing material, for example a resilient material such as an elastomer or foamed plastic.

Figure 13:
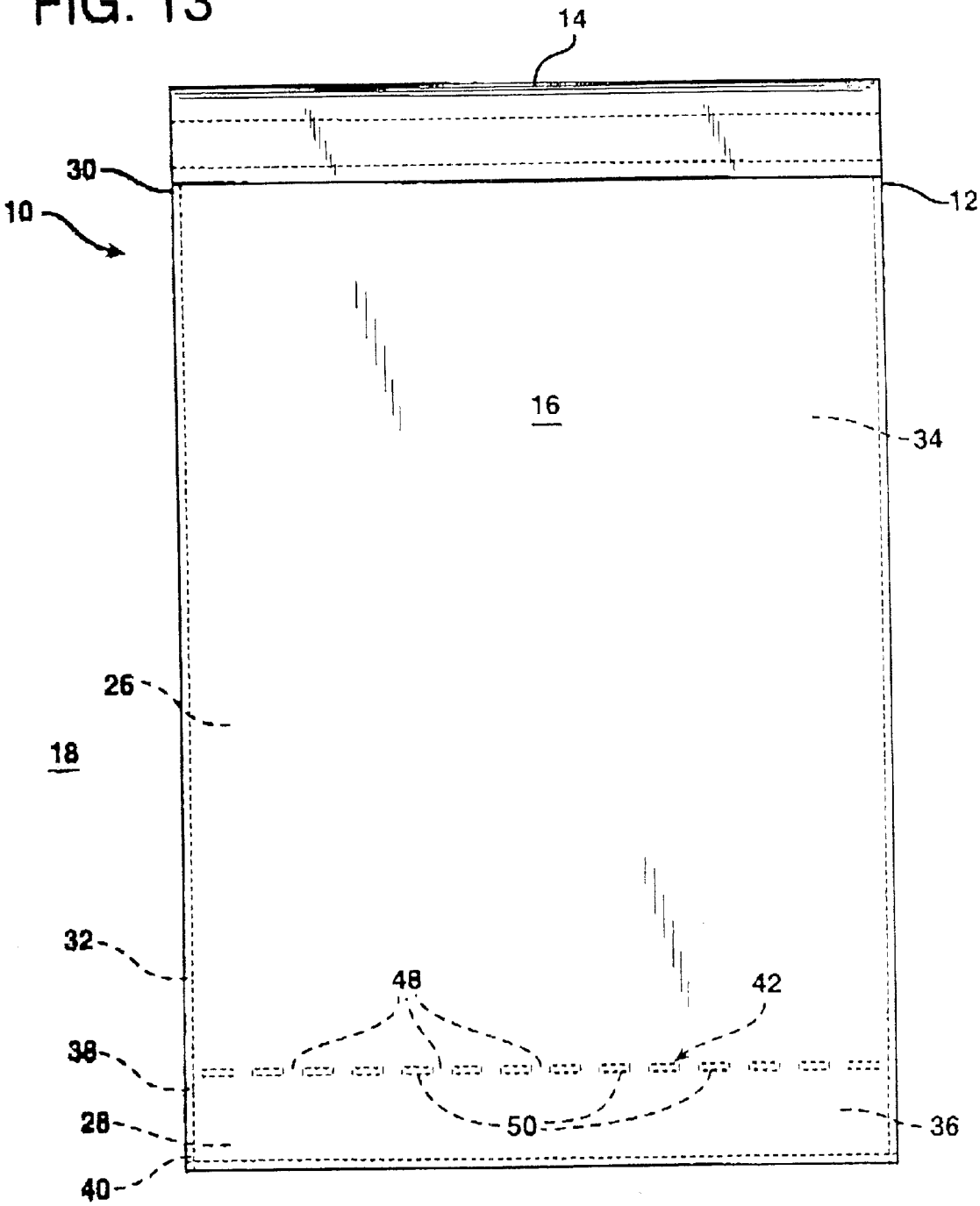
FIG. 13 is a representational plan view of a mail collection bag of the present invention.

Bag 10 defines a bag interior space 16 and bag exterior space 18. (FIGS. 2, 13.) Bag 10 includes bag inlet portion 12, which defines bag inlet opening 14. Useful bags are discussed in more detail below.

Figure 3:
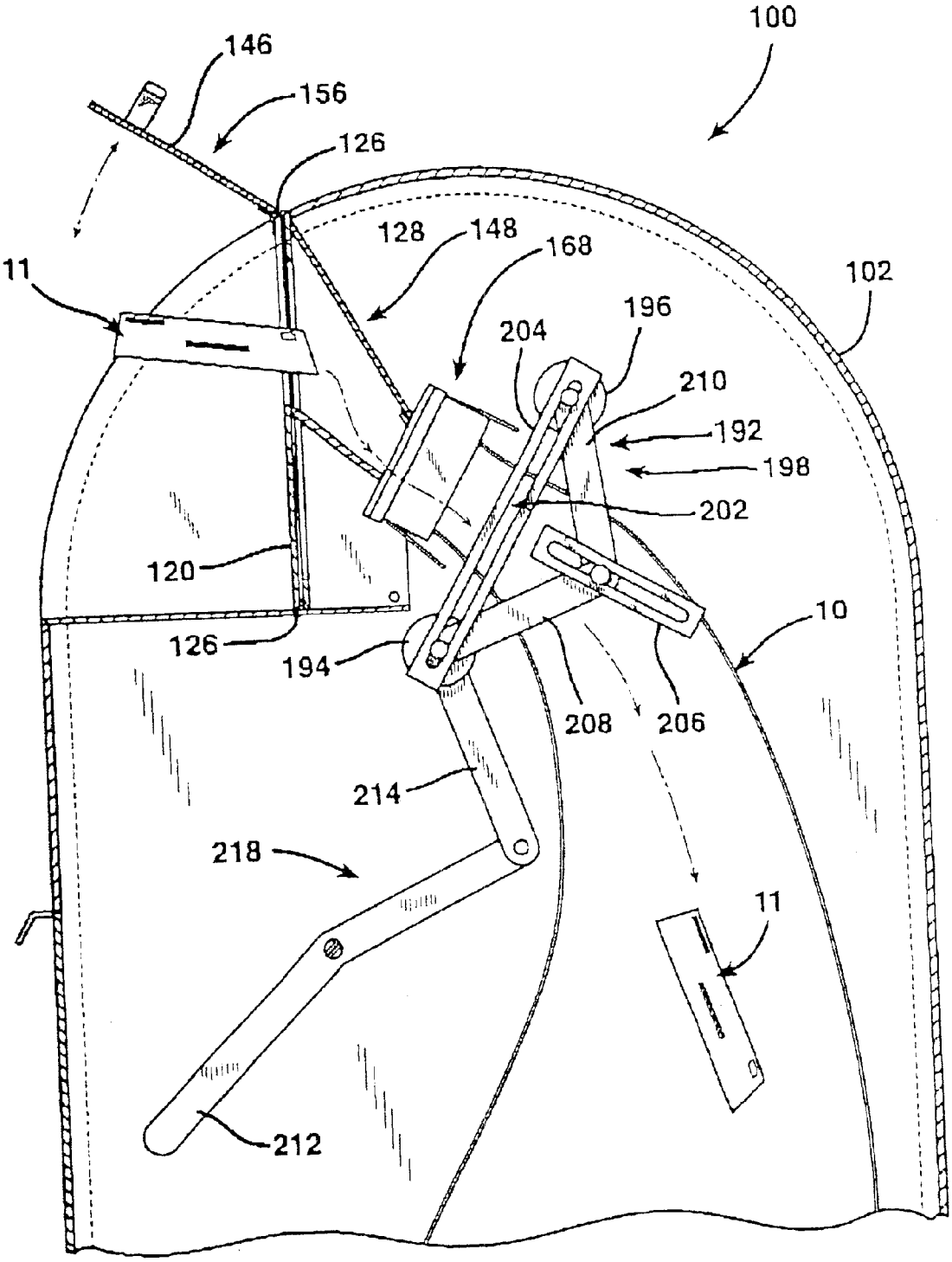
FIG. 3 is an expanded representational sectional view of the top portion of FIG. 2 with the chute door in the open position.

Bag 10 and chute 128 may be moveable relative each other between a mail collection mode 170 (FIG. 5) and a mail deposit mode 168 (FIGS. 2–3, 7). In mail collection mode 170, chute 128 and bag 10 are spaced apart from each other, for example, chute 128 may be placed in the chute up position 154.

Figure 9:
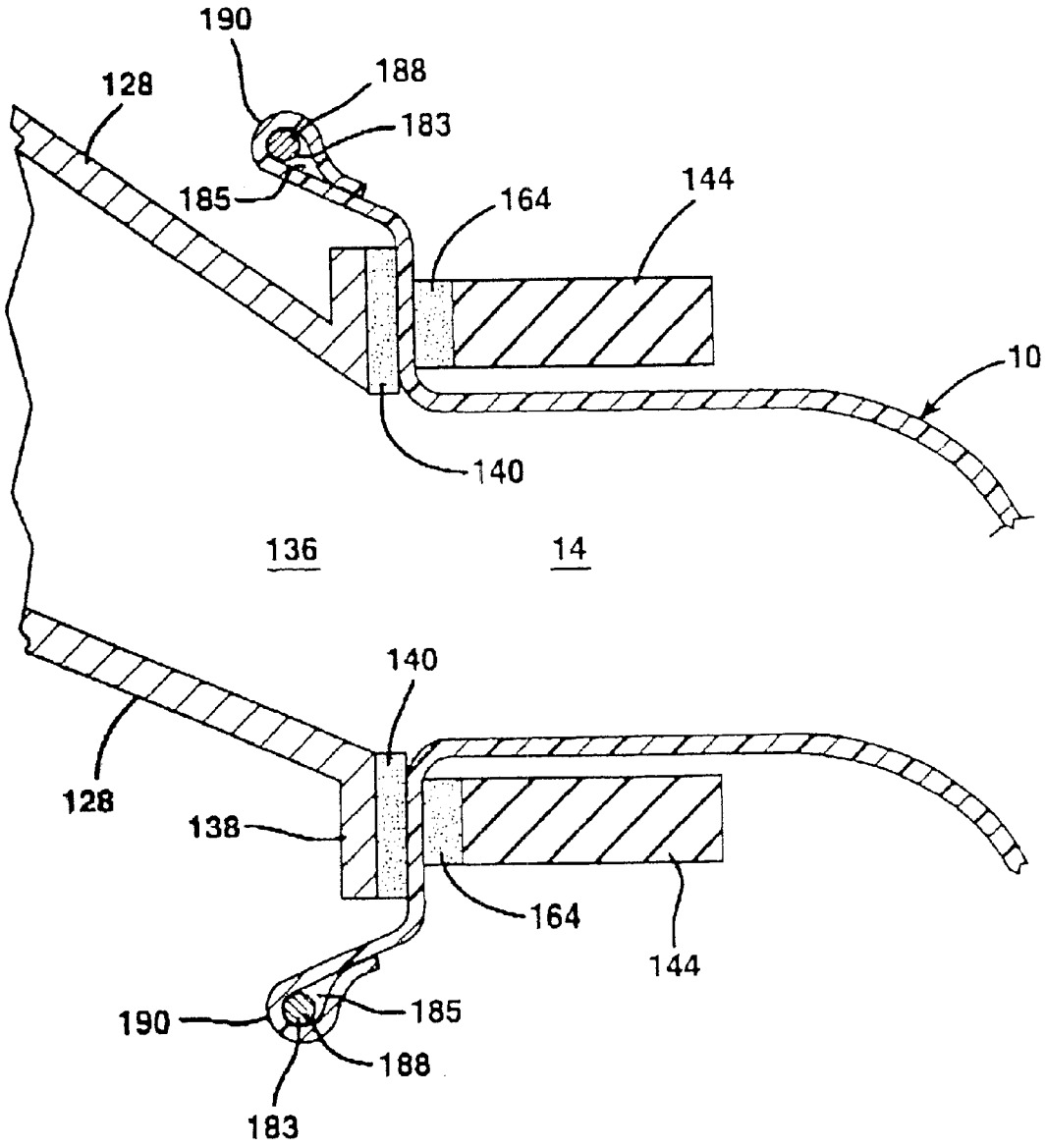
FIG. 9 is a representational fragmentary sectional view of the chute of the mail collection box with support rods and the mail collection bag with receiving loops in the mail deposit mode.
Figure 10:
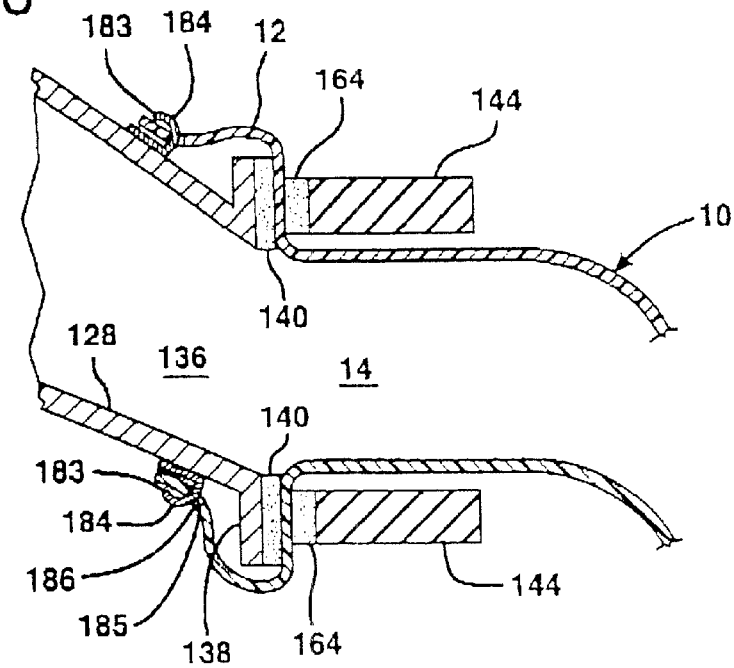
FIG. 10 is a representational fragmentary sectional view of the chute of the mail collection box with support hooks and the mail collection bag with receiving eyelets in the mail deposit mode.
Figure 11:
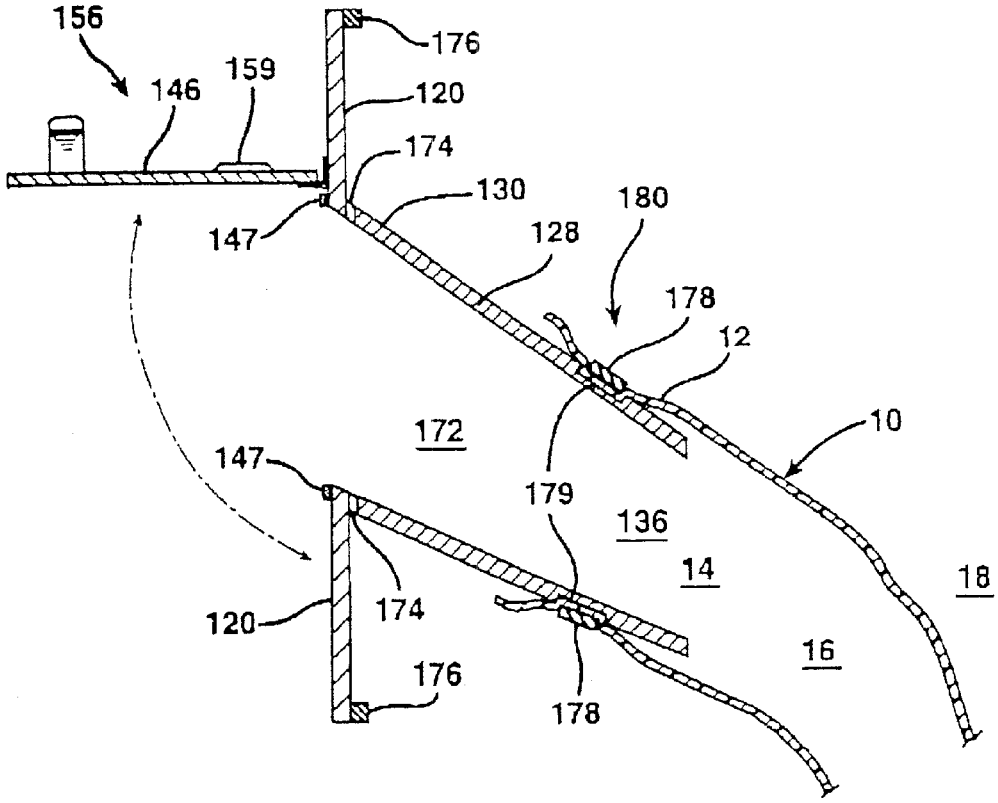
FIG. 11 is a representational fragmentary sectional view of the chute of the mail collection box fixedly supported by the housing and the mail collection bag in the mail deposit mode.

In mail deposit mode 168, chute 128 and bag 10 cooperate to form a mail deposit pathway 172 from the chute inlet opening 132 to the bag inlet opening 14. (FIGS. 7, 11.) For example, bag 10 and chute 128 may directly engage each other in the mail deposit mode 168. (FIGS. 7, 9–11.) The mail deposit pathway 172 may be an "enclosed" pathway, as shown in FIGS. 7, 11, that is, where the only openings allowing either access to or from the mail deposit pathway 172 are the chute inlet opening 132 and the bag inlet opening 14 (i.e., an unapertured pathway between the chute inlet opening 132 and the bag inlet opening 14). In mail deposit mode 168, chute 128 may be in the chute down position 148. Further in mail deposit mode 168, bag 10 may be completely contained within housing interior space 104.

In mail deposit mode 168, inlet portion 12 of bag 10 may be sealingly engaged with chute 128. In this context, "sealingly engaged" means that a seal is formed between the chute and bag capable of preventing the passage of any amount of liquid water placed against the seal in a 24 hour period at ambient conditions of 72° F. and atmospheric pressure of 14.7 psia. Chute 128 and bag inlet portion 12 may engage each other to form a seal capable of preventing the passage of detectable amounts of 1 micron diameter airborne solid particles exposed to the seal in a 24 hour period at ambient conditions of 72° F. and atmospheric pressure of 14.7 psia.

The sealing engagement between bag 10 and chute 128 may be made, for example, by positioning inlet portion 12 of bag 10 between chute 128 and collar 144 so that inlet portion 12 is compressed between chute 128 and collar 144. (FIGS. 7, 9–10.) The sealing engagement may also be made by simultaneously positioning sealing band 178 around the circumference of chute 128 and the inlet portion 12 of bag 10 so that inlet portion 12 is compressed between sealing band 178 and chute 128, for example, within groove 179 of chute 128. (FIG. 11.) Sealing band 178 may comprise any suitable elastic or resilient material, for example, elastomers or rubbers, such that sealing band 178 may be stretched to allow the insertion or removal of the inlet portion 12 of bag 10. Sealing band 178 may also take the form of a mechanical clamp or belting system (not shown) capable of compressing inlet portion 12 against chute 128 to form the sealing engagement between the inlet portion of the bag and the chute around the circumference of the chute. Sealing band 178 may be moveable between a sealing position 180 (FIG. 11), in which the sealing band 178 encircles the inlet portion 12 of bag to form the sealing engagement of the mail deposit mode 168, and a spaced position 182 (FIG. 12), in which the sealing band 178 is spaced apart from bag 10.

At least in the mail deposit mode 168, bag 10 may be supported at least in part by chute 128 or by housing 102. For example, chute 128 may comprise one or more support members 183 (e.g., hooks 184), which may be adapted to support bag 10 by extending through one or more corresponding receiving openings 185 (e.g., eyelets 186) in the inlet portion 12 of bag 10. (FIG. 10.) Alternatively, housing 102 may comprise one or more support members 183 (e.g., rods 188), which may be adapted to support bag 10 by extending through one or more receiving openings 185 (e.g., receiving loops 190) in the inlet portion 12 of bag 10. (FIG. 9.)

Chute door 146 may support and/or include an evacuation port, coupling, or valve 159. (FIG. 7.) The evacuation port 159 may be adapted to be adjustable between an open position and a normally closed position. In the open position, the evacuation port 159 provides fluid communication access from the evacuation coupling through chute door 146 and mail deposit pathway 172 (discussed below) to bag interior space 16, when the chute door is in the chute door closed position 158 (FIG. 2). In the closed position, the evacuation port blocks fluid communication through the evacuation port, coupling or valve 159. The chute door 146 may include chute door gaskets 147 proximate the perimeter of the chute door—and/or the deposit door 120 may include chute door gasket 147 surrounding the chute inlet opening 132—to facilitate a seal between the chute door and the housing in the chute door closed position 158. The quality and type of seal may be that of any of the seals described below. The chute door may include one or more latches (not shown) to facilitate the formation of a seal between the chute door and the deposit door in the chute door closed position.

The mail collection box 100 may comprise clamp 192 supported by housing 102. (FIG. 3.) Clamp 192 may include front clamp member 194 and rear clamp member 196 in opposing arrangement. Clamp 192 may be adjustable between a clamp open mode 198 (FIG. 3), in which the front and rear clamp members are spaced apart, and a clamp closed mode 200 (FIG. 6), in which the front and rear clamp members are proximate each other and adapted to squeeze bag 10 between the front and rear clamp members 194, 196 to form closed bag 22. Closed bag 22 has a closed bag volume 20 that comprises at least a portion of bag interior volume 16. Front and rear clamp members 194, 196 may comprise a resilient surface adapted to facilitate squeezing bag 10 between the clamp members. The front or rear clamp members may comprise rollers, as shown in FIGS. 3–6.

In the clamp open mode 198, clamp 192 defines an insertion zone 202 between the front and rear clamp members. In the mail deposit mode 168, at least a portion of bag 10 may be positioned in insertion zone 202, for example, so that bag inlet portion 12 is on one side of insertion zone 202 and another portion of bag 10 is on the other side of insertion zone 202. In the clamp closed mode 200, closed bag 22 may form a bag seal 24 between the front and rear sheets 44, 46 such that the sheets are sealingly engaged. In this context, "sealingly engaged" means that a seal is formed between the sheets capable of preventing the passage of any amount of liquid water placed against the seal in a 24 hour period at ambient conditions of 72° F. and atmospheric pressure of 14.7 psia. Further, the front and rear sheets of bag 10 may engage each other to form a seal capable of preventing the passage of detectable amounts of 1 micron diameter airborne solid particles exposed to the seal in a 24 hour period at ambient conditions of 72° F. and atmospheric pressure of 14.7 psia.

Further, in the clamp closed mode 200, clamp 192 may be adapted to squeeze bag 10 between the front and rear clamp members with increasing force as an increasing force attempting to withdraw bag 10 (e.g., downward force) is applied to bag 10.

Front and rear clamp members 194, 196 may be adapted to cooperate to heat seal bag 10. For example, front and rear clamp members may comprise the front and rear heat sealing bars of a heat sealer, such as a bar sealer or an impulse sealer. For example, one of the front or rear clamp members may be a heater bar and the other member may have a resilient surface opposing the heater bar.

Clamp 192 may comprise one or more transverse rails 204 that moveably support front and rear clamp members 194, 196. (FIG. 3.) The transverse rails may be supported by housing 102. Clamp 192 may also comprise one or more lateral rails 206, which may be supported by housing 102. One or more front struts 208 may be positioned between front clamp member 194 and lateral rails 206 so that one end of each front strut is connected to the front clamp member 194 and the other end of the front strut is moveably supported by lateral rail 206. One or more rear struts 210 may be positioned between rear clamp member 196 and lateral rails 206 so that one end of each rear strut is connected to the rear roller and the other end of the rear strut is moveably supported by lateral rail 206. Clamp 192 may also comprise lever arm 212 pivotally mounted to housing 102 and having one end pivotally mounted to one end of actuator strut 214. The other end of actuator strut 214 may be pivotally mounted to front strut 208 or to front clamp member 194. Lever arm 212 is moveable between an actuated mode 216, which places clamp 192 in the clamp closed mode 200, and a release mode 218, which places clamp 192 in the clamp open mode 198.

Mail collection box 100 may include tray 220. (FIG. 1.) Tray 220 may be removeably received and supported by one or more notches or slots 222 formed in housing 102. The slots 222 may be positioned at varying selected levels so that tray 220 may be inserted at different desired heights within housing interior space 104. Housing 102 may support bag 10 by supporting tray 220 upon which bag 10 rests. Tray 222 may also support bucket 224.

Bag

Figure 14:
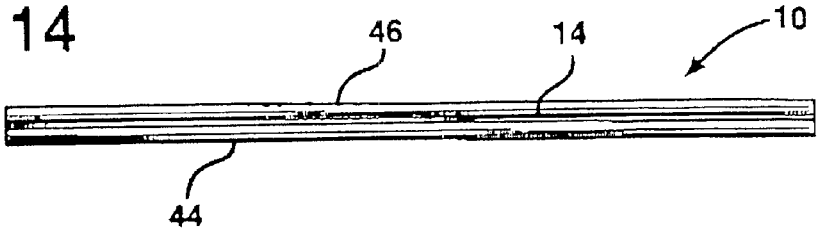
FIG. 14 is a representational top view of the mail collection bag.

Bag 10 may comprise front sheet 44 and rear sheet 46, which may be sealed together (e.g., heat or adhesively sealed) along one or more edges or portions of the perimeter to form the bag. (FIGS. 13–14.) Bag 10 may be gusseted or non-gusseted. Bag 10 or front and/or rear sheets 44, 46 may comprise one or more plastics, such as thermoplastic polymers, of sufficient thickness and performance characteristics to withstand the expected and desired use conditions. All or a portion of front and rear sheets may be crosslinked to a desired level to improve the strength or other properties of the sheets, for example, by subjecting the sheet material to one or more energetic radiation treatments to induce crosslinking between molecules of the irradiated material. Bag 10 or front and/or rear sheets 44, 46 may be free heat shrinkable by at least about 5% in at least two (machine and transverse) directions, measured according to ASTM D2732 (10 cm×10 cm samples at 185° F.). All or selected portions of bag 10 or front and/or rear sheets 44, 46 may be transparent, for example, having a transparency (i.e., clarity) of at least about any of the following values: 65%, 70%, 75%, 80%, 85%, and 90%, measured in accordance with ASTM D1746. "Transparent" as used herein means that the material transmits incident light with negligible scattering and little absorption, enabling objects to be seen clearly through the material under typical unaided viewing conditions (i.e., the expected use conditions of the material).

Figure 24:
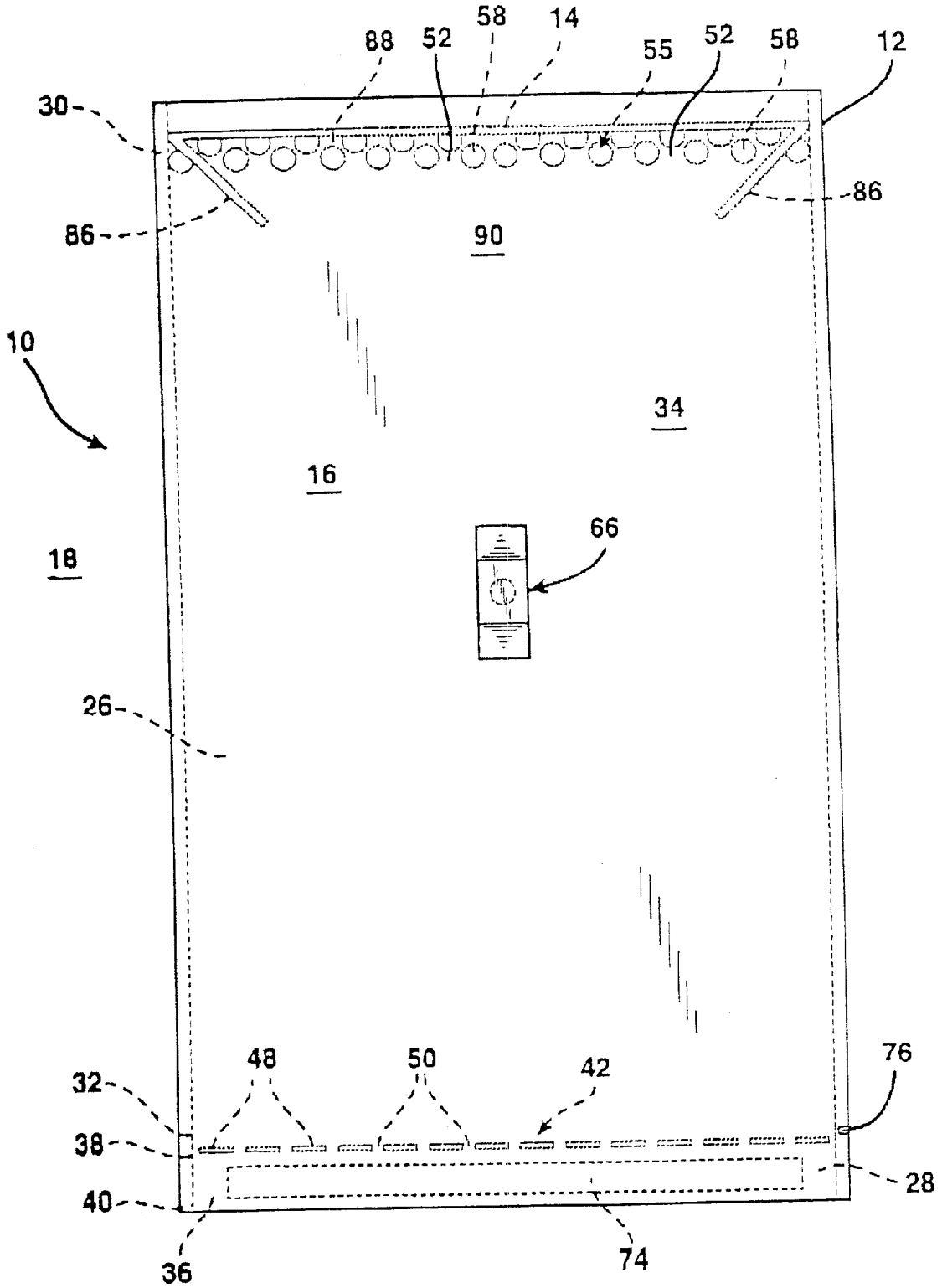
FIG. 24 is a representational plan view of the mail collection bag having a filter patch, specimen strip, and funnel.

Bag 10 may comprise upper chamber 26 and lower chamber 28. (FIGS. 13, 24.) Upper chamber 26 comprises inlet end 30 and bottom end 32 opposite inlet end 30. Inlet end 30 may define bag inlet opening 14. Upper chamber 26 defines upper chamber interior volume 34. Lower chamber 28 comprises top end 38 of the lower chamber and bottom end 40 opposite the top end 38. Lower chamber 28 defines lower chamber interior volume 36. Lower chamber interior volume 36 may be less than upper chamber interior volume 34.

Bag 10 may comprise strainer 42 connecting and/or between bottom end 32 of the upper chamber 26 and top end 38 of the lower chamber 28. Strainer 42 may place upper chamber interior volume 34 in fluid communication with lower chamber interior volume 36. Strainer 42 may comprise selected portions of front and rear sheets 44, 46 intermittently sealed to each other in seal zones 50 to define a plurality of strainer openings 48 placing upper chamber interior volume 34 in fluid communication with lower chamber interior volume 36.

Bag inlet portion 12 (e.g., inlet end 30 of upper chamber 26) may define one or more receiving openings 185, for example, loops 190 (FIGS. 9, 16, 19) and receiving eyelets 186 (FIG. 10).

Figure 15A:
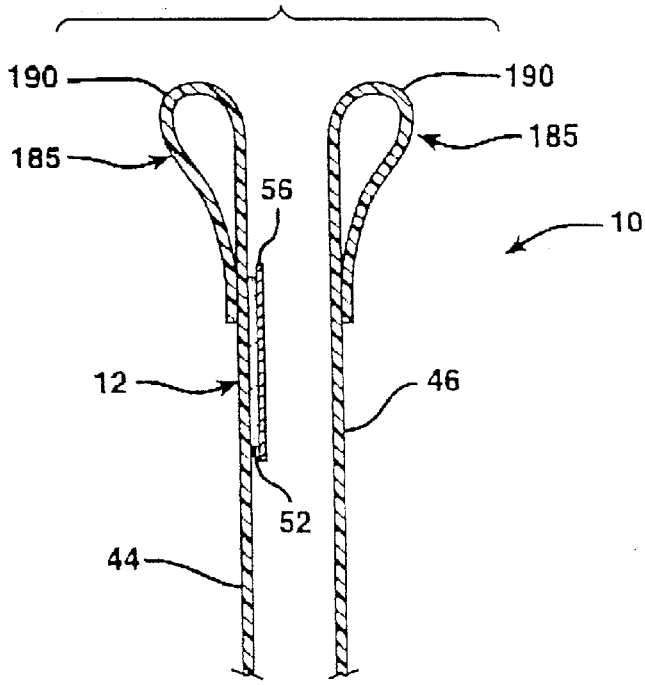
FIG. 15*a* is a representational fragmentary sectional side elevation view of the top portion of the mail collection bag of FIG. 14.
Figure 15B:
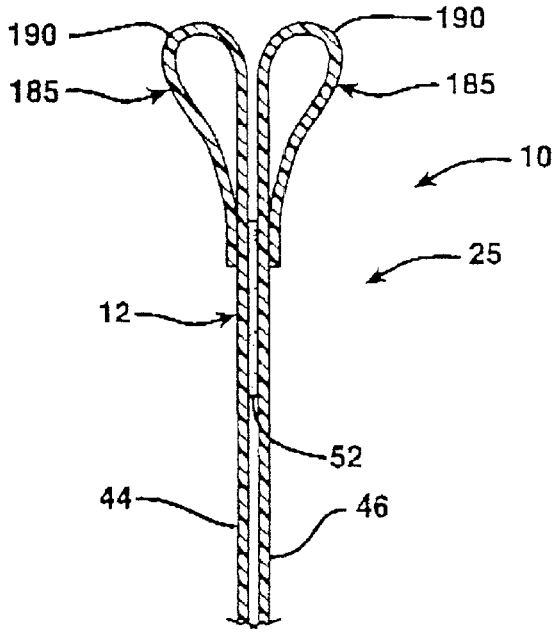
FIG. 15*b* is a representational fragmentary sectional side elevation view of the top portion of a sealed mail collection bag.
Figure 16:
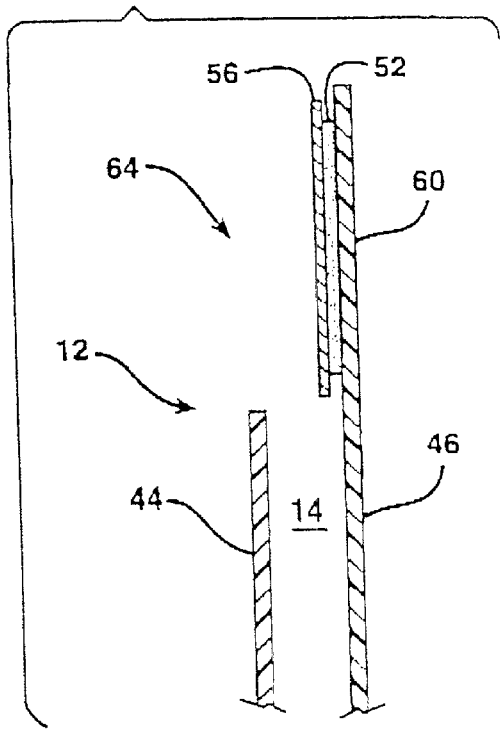
FIG. 16 is a representational fragmentary sectional side elevation view of the top portion of a first open mail collection bag having a closure flap.
Figure 18:
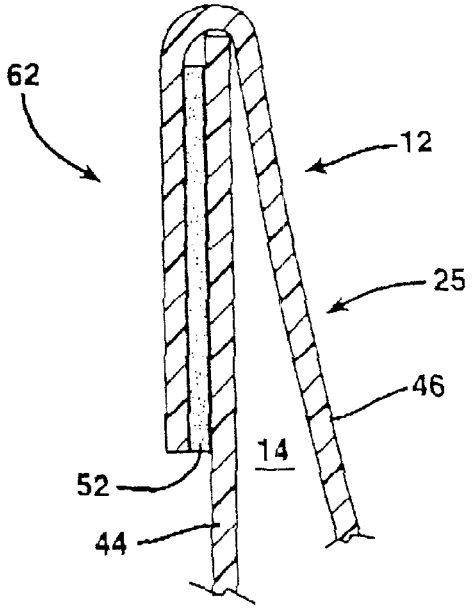
FIG. 18 is a representational fragmentary sectional side elevation view of the top portion of a sealed bag of the type shown in the open state in FIG. 16 or 17.

Bag inlet portion 12 may be adapted so that inlet opening 14 is sealably closeable, for example by heat sealing or by adhering the front and rear sheets 44, 46 together in one or more selected zones to form sealed bag 25 (FIGS. 15*b*, 18). An exemplary sealably closeable bag is disclosed by U.S. Pat. No. 5,205,649 entitled "Leakproof Packaging" by Fullerton issued Apr. 27, 1993, which is incorporated herein in its entirety by reference. Such a seal formed between the front and rear sheets may be capable of preventing the passage of any amount of liquid water placed against the seal in a 24 hour period at ambient conditions of 72° F. and atmospheric pressure of 14.7 psia. Such a seal may be capable of preventing the passage of detectable amounts of 1 micron diameter airborne solid particles exposed to the seal in a 24 hour period at ambient conditions of 72° F. and atmospheric pressure of 14.7 psia. Sealed bag 25 may be capable of being immersed in liquid water for a 24 hour period at ambient conditions of 72° F. and atmospheric pressure of 14.7 psia without the passage of any amount of liquid water into the interior space of the sealed bag. Sealed bag 25 may be capable of preventing the passage of detectable amounts of 1 micron diameter airborne solid particles from the interior of the sealed bag to the exterior of the bag in a 24 hour period at ambient conditions of 72° F. and atmospheric pressure of 14.7 psia.

Sealed bag 25 may comprise a tamper evident closure or feature (not shown), for example, as disclosed in any of U.S. Pat. No. 5,798,169 entitled "Self-Containing Tamper Evident Seal"; U.S. Pat. No. 5,631,068 entitled "Self Containing Tamper Evident Tape and Label"; and U.S. Pat. No. 6,264,033 entitled "Article with Improved Tamper Evidence"; each of which is incorporated herein by reference.

Figure 19:
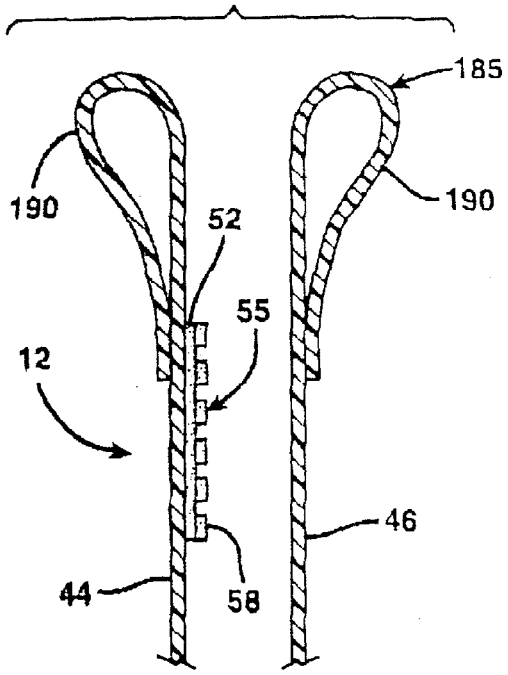
FIG. 19 is a representational fragmentary sectional side elevation view of the top portion of an open mail collection bag having a first release-linerless closure system.
Figure 20:
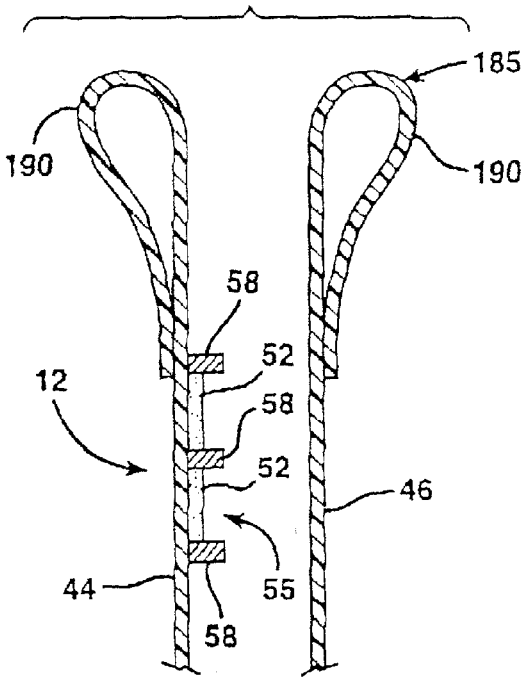
FIG. 20 is a representational fragmentary sectional side elevation view of the top portion of an open mail collection bag having a second release-linerless closure system.

To facilitate formation of a sealably closed bag (i.e., sealed bag 25), bag 10 may comprise an adhesive 52 on the inside surface 54 of front sheet 44. Useful adhesives are known in the art. Protective strip or release liner 56 may be peelably adhered to adhesive 52 to prevent premature adhesion of adhesive 52 to another surface (e.g., rear sheet 46) before the protective strip is removed. (FIG. 15*a*.) Alternatively, a release-linerless system 55 may be used, for example, in which resilient material 58 may be adjacent to (e.g., cover or surround) selected portions of adhesive 52 by extending above the surface of the adhesive 52 to prevent premature contact or adhesion of adhesive 52 to another surface when the resilient material is in a non-compressed state. (FIGS. 19–20.) Resilient material 58 may comprise any material having suitable resiliency characteristics, for example, foam or other resilient or spongy material that takes up a smaller volume upon compression. The non-compressed height of resilient material 58 may be greater than that of adhesive 52 to prevent the first and second surfaces to be adhered from prematurely adhering. Resilient material 58 may be positioned and adapted to allow selected portions of adhesive 52 to contact another surface upon compressing resilient material 58, for example, by squeezing it between the surfaces to be adhered so that both surfaces contact the adhesive to form the seal.

Figure 17:
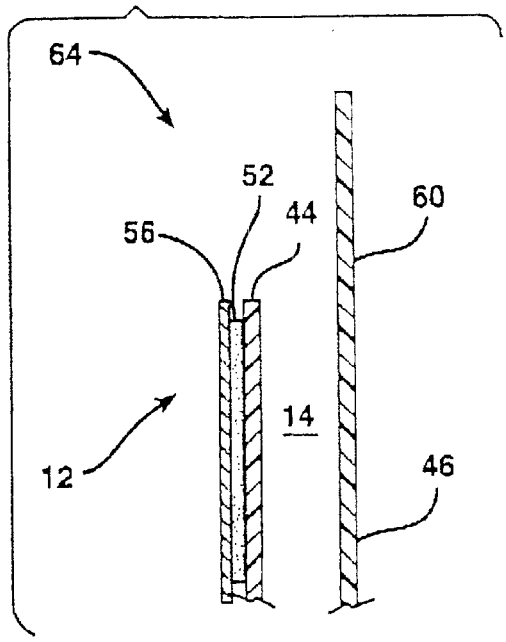
FIG. 17 is a representational fragmentary sectional side elevation view of the top portion of a second open mail collection bag having a closure flap.

Bag 10 may comprise closure flap 60 connected to bag inlet portion 12 (e.g., inlet end 30 of upper chamber 26). Closure flap 60 may comprise, for example, an extended integral portion of rear sheet 46 (FIGS. 16–18) or a separate sheet portion (not shown) attached to rear sheet 46. Closure flap 60 is moveable or foldable between a flap closed position 62 (FIG. 18), in which closure flap 60 covers inlet opening 14, and a flap open position 64 (FIGS. 16–17), in which closure flap 60 is positioned to allow access through inlet opening 12 to the bag interior space 16 (e.g., upper chamber interior volume 34). In the flap closed position 62, flap 60 may be adhesively secured to the bag inlet portion 12. For example, adhesive 52 may cover a portion of closure flap 60 (FIG. 16), or adhesive 52 may cover a portion of the exterior surface of front sheet 44 (FIG. 17). Alternatively in the flap closed position 62, flap 60 may be heat sealed to the bag inlet portion 12.

Figure 21:
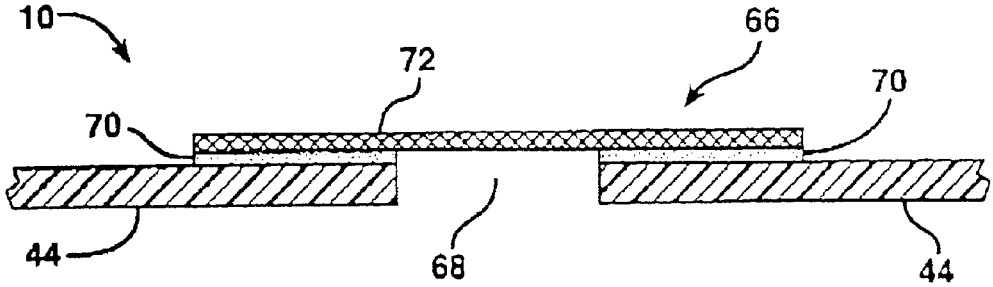
FIG. 21 is a representational fragmentary sectional side elevation view of the filter patch of FIG. 24.

Bag 10 may comprise one or more filter patches 66. (FIGS. 21, 24.) Filter patch 66 may be attached to the front or rear sheets or to upper or lower chambers 26, 28, for example, adhesively attached by filter adhesive 70, to cover an outlet port 68 in front sheet 44 or rear sheet 46. Either of upper chamber 26 and lower chamber 28 may define outlet port 68. Filter patch 66 comprises a filter medium 72 capable of entrapping airborne particles having a diameter of one micron or greater that may be carried by air passing through the filter patch 66. Examples of such filter medium and filters are HEPA ("high efficiency particle air") filters and filter medium, which are designed to entrap 99.97% of 0.3 to 1 micron particles, HEPA-type filters and filter medium, and ULPA ("ultra low penetration air") filters and filter medium, which are designed to entrap 99.999% of 0.12 to 1 micron particles. Useful filter medium and adhesives are known in the art.

The filter patch 66 may be removeably attached so that it may be removed from bag 10. Bag 10 may comprise a resealing patch (not shown) attached proximate filter patch 66 (e.g., attached to filter patch 66 or to front or rear film 44, 46) adapted to cover or seal the outlet port 68 after filter patch 66 or a portion of filter patch 66 (e.g., filter medium 72) is removed from bag 10. The resealing patch may comprise, for example, a plastic sheet large enough to cover the outlet port 68 and adhesive capable of forming the desired seal with the surface surrounding the outlet port.

Bag 10 may also comprise a one-way valve (not shown) or a coupling (not shown) covering outlet port 68. The one-way valve may be adapted to preclude air from entering the bag and to allow air to escape the bag when the valve is engaged. The coupling may be adapted to provide a connection point for a vacuum hose, as discussed below. Any of the outlet port, one-way valve, or coupling may have a covering (not shown), for example, a removable covering, to prevent air passage through the outlet port when the cover is engaged.

Bag 10 may comprise a specimen strip 74 in the bag interior space 16. (FIG. 24.) Specimen strip 74 may comprise a material capable of entrapping airborne particles having a diameter of one micron or greater that may encounter the material. Examples of suitable materials include adhesives, adhesive-coated films, porous films, fibrous films, cellulose-based tissues, and spun-woven materials. Specimen strip 74 may comprise one or more indicator reagents that react with one or more compounds that may be associated with biocontaminants or other undesired contaminants, for example, to produce a color change. The specimen strip 74 may be positioned within lower chamber interior volume 36 of lower chamber 28.

Bag 10 may comprise one or more easy-open notches 76 adapted to facilitate tearing open bag 10. (FIG. 24.) Easy-open notch 76 may be positioned along an edge of the bag, for example, proximate an edge of lower chamber 28 to facilitate access to lower chamber interior volume 36, for example, to gain access for removal of specimen strip 74. Easy-open notch 76 may be positioned proximate an edge of bottom end 32 of upper chamber 26, for example, to facilitate access to upper chamber interior volume 34 for removal of deposited mail (not shown).

Figure 22:
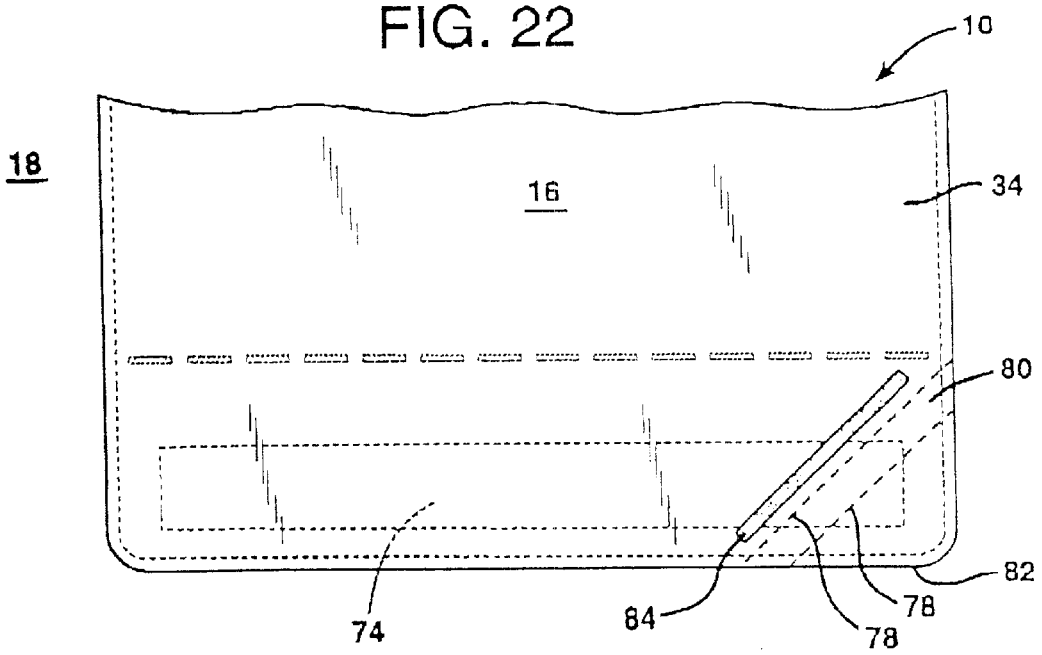
FIG. 22 is a representational fragmentary plan view of the bottom portion of an alternative mail collection bag enclosing a specimen strip.
Figure 23:
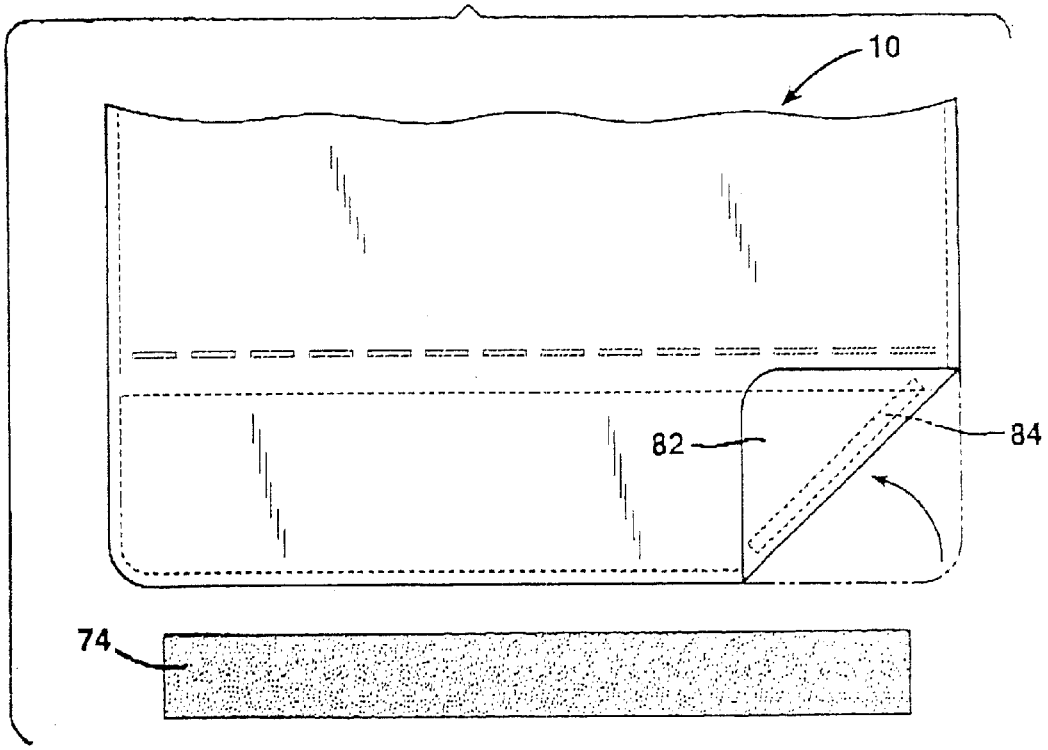
FIG. 23 is a representational fragmentary plan view of the bottom portion of an alternative mail collection bag of the type shown in FIG. 22 having the specimen strip removed and the bag reclosed.

Bag 10 may also comprise one or more lines of opening 78, which are portions of bag 10 adapted to facilitate opening bag 10 along a line—for example by scoring or otherwise intentionally weakening portions of bag 10 so that the bag may be opened in a desired area to gain access to the bag interior space 16, for example, to gain access to the specimen strip 74 by tearing out access portion 80. (FIGS. 22–23.) A portion of bag 10, for example corner 82, may be adapted to be folded over and adhered to adhesive strip 84, which may be proximate the lines of opening 78, to reclose or reseal bag 10 and cover the opening formed after the one or more lines of opening 78 have been opened, and for example access portion 80 has been removed. (FIG. 23.)

Bag 10 may comprise funnel 84 attached proximate to the bag inlet portion 12. Funnel 84 has a relatively large funnel inlet end 88 and an opposing relatively small funnel outlet end 90. Outlet end 90 may be positioned within bag interior space 16, for example, upper chamber interior volume 34. (FIG. 24.) Funnel 84 (i.e., funnel inlet end 88) may define bag inlet opening 14. The interior surface of funnel 84 may comprise a fibrous, an open-celled, or spun-woven material, or an adhesively or other suitably coated material, to facilitate entrapment of particles having a diameter of one micron or greater that may be on the exterior of mail passing through funnel 86.

One or more of articles such as the mail collection box 100, the bag 10, the filter patch 66, and the specimen strip 74 may include applied or associated identification information in the form of machine- or human-readable symbolic, alpha, and/or numeric information, for example, a printed bar-coded label or tag (not shown). Bag 10 may include an an effective amount of ink susceptible to changing color upon exposure to selected amounts or types of radiation, as discussed below. Irradiation indicator inks and their effective amounts are known to those of skill in the art.

Use of the Mail Collection Box and Bag

To install bag 10 in an empty mail collection box 100, access door 110 may be placed in the door open position 114 to allow access to lever arm 212, which may then placed in the release mode 218 to position clamp 192 in the clamp open mode 198. (FIG. 8.) Tray 220 may be positioned at the desired height by installing it in selected slots 222. Bucket 224 may be inserted on top of tray 220 to further support the bag. Access door 110 may be placed (and optionally locked) in the door closed position 116. (FIG. 2.)

Deposit door 120 may then be placed in the deposit door open position 122 (FIG. 1), for example, by unlocking deposit door locking mechanism 142 and raising the deposit door. This provides access to the housing interior space 104 through mail deposit opening 118.

If chute 128 is moveably supported by housing 102 (i.e., the first embodiment discussed above), chute 128 may be placed in chute up position 154. (FIG. 1.) Bag 10 may then be inserted through mail deposit opening 118 and collar opening 160 of collar 144. Bag inlet portion 12 may be arranged, folded back, or reversed over collar inlet surface 162 of collar 144 to define bag fold-over portion 92 so that the bag inlet portion 12 covers collar inlet surface 162. (FIG. 7.) If provided, receiving openings 185 of the bag may be installed onto support members 183 supported by the housing. Chute 128 may be placed in the chute down position 148 so that chute 128 and bag 10 are positioned in the mail deposit mode 168 forming mail deposit pathway 172. (FIGS. 2–3, 7.)

Figure 12:
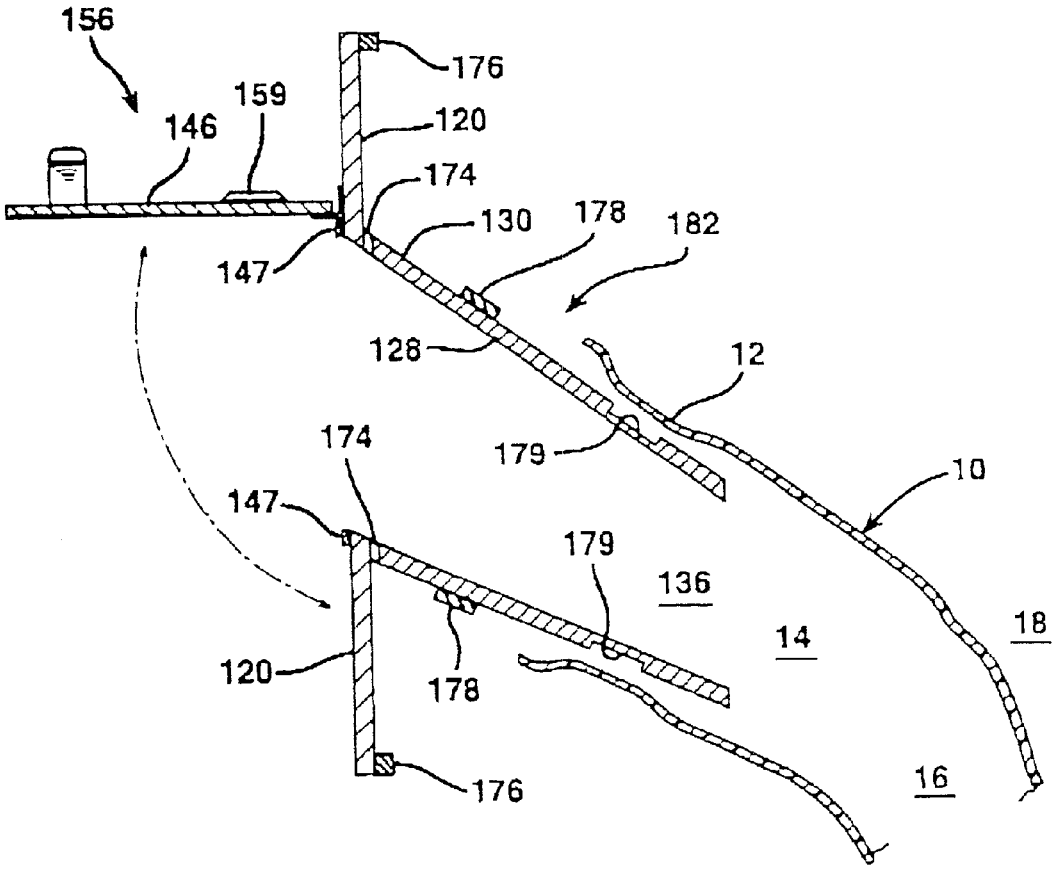
FIG. 12 is a representational fragmentary sectional view of the chute of the mail collection box fixed supported by the housing and the mail collection bag in the spaced apart position.

If chute 128 is fixedly supported by housing 102 (i.e., the second embodiment discussed above), bag 10 may be inserted through mail deposit opening 118 and positioned so that the bag inlet portion 12 covers chute outlet end 134. (FIG. 12.) If provided, receiving openings 185 of the bag may be installed onto support members 183 supported by the chute or by the housing. (FIGS. 9–10.) Sealing band 178 may be moved to the sealing position 180 around the bag inlet portion 12 and chute 128 to place chute 128 and bag 10 in the mail deposit mode 168 forming mail deposit pathway 172. (FIG. 11.)

Once in mail deposit mode 168, mail 11 may be deposited into mail collection box 100 and into bag 10 by placing chute door 146 in the chute door open position 156 (FIGS. 3, 7, 11) so that mail 11 may be deposited through chute inlet opening 132 to fall down mail deposit pathway 172 into bag interior space 16.

If it is desired to evacuate air from bag interior space 16 before collecting bag 10 containing deposited mail, a vacuum hose (not shown) may be engaged with the evacuation port, coupling, or valve 159 of the chute door. (FIG. 2.) The chute door 146 may be latched to the closed position, for example, to enhance the seal between the chute door and the deposit door. The evacuation port 159 may be manually moved to the open position or automatically adjusted to the open position upon engagement of the vacuum hose. Upon activation of the vacuum source, air may be withdrawn through chute door 146 and mail deposit pathway 172 from bag interior space 16, thereby at least partially collapsing the volume of the bag.

To collect the bag 10 containing deposited mail 11 from the collection box 100, access door 110 is unlocked and placed in the door open position 114. (FIG. 4.) Clamp 192 then is moved to the clamp closed mode 200 by placing lever arm 212 in the actuated mode 216. This forms bag seal 24 between the front and rear clamp members 194, 196 to reduce the likelihood of airborne particles that may be within bag interior space 16 from exiting the bag through the bag inlet opening 14, for example, during the subsequent bag sealing steps discussed below. If adhesive 52 of bag 10 is used without a release liner 56 (i.e., a release-linerless system 55, for example as shown in FIGS. 19, 20)—and adhesive 52 has been positioned in insertion zone 202 between the front and rear clamp members 194, 196—then the placement of clamp 192 in the closed mode may force the front and rear clamp members together to squeeze the adhesive between front and rear sheets 44, 46 of bag 10 to form sealed bag 25. Alternatively, if front and rear clamp members are sealing bars of a heat sealer, then one or both of the bars may be heated or actuated while the clamp members squeeze the front and rear sheets 44, 46 together to form a seal closing the bag inlet opening to form sealed bag 25. If air has been withdrawn from the bag interior 16, as discussed above, then the placement of clamp 192 in the clamp closed mode may form sealed bag 25 having a reduced or collapsed volume. If used, the vacuum hose may then be disconnected from the evacuation port 159.

Next, lock 142 on deposit door 120 may be unlocked so that deposit door 120 may be placed in the door open position 122. In the first embodiment if chute 128 is moveably supported by the deposit door, the placement of the deposit door in the door open position moves chute 128 to the chute up position 154, which places chute 128 and bag 10 in the mail collection mode 170. (FIG. 5.) The bag inlet portion 12 of bag 10 may then be accessed. If provided, receiving loops 190 of the bag may be withdrawn from rods 188. In the second embodiment having chute 128 fixedly supported by the housing 102, the bag inlet portion 12 of bag 10 may be accessed through mail deposit opening 118. If provided, receiving eyelets 186 of the bag may be withdrawn from hooks 184. If used, sealing band 178 may be moved to the spaced position 182 to place chute 128 and bag 10 in the mail collection mode 170. (FIG. 12.)

If not already done so before placing the chute and bag in the mail collection mode 170, bag 10 may then be sealably closed to form sealed bag 25. If the adhesive 52 of bag 10 is positioned outside of insertion zone 202 between the front and rear clamp members 194, 196—for example, on fold-over portion 92 of bag 10 (FIG. 7)—then the bag may be sealed closed by manually or otherwise pressing adhesive 52 between front and rear sheets 44, 46 to form a sealed bag 25 (FIGS. 15*a* and 18). If a protective liner 56 is used, then it is first removed from adhesive 52 before squeezing the adhesive between the front and rear sheets. If bag 10 comprises a closure flap 60, then the flap is folded from the flap open position 64 (FIGS. 16–17) to the flap closed position to form a sealed bag 25 (FIG. 18).

Once sealed bag 25 has been formed, then clamp 192 may be placed in the clamp open mode 198 so that the inlet portion 12 of bag 10 may be removed from insertion zone 202 between the front and rear clamp members. Sealed bag 25 may then be removed through access opening 112 of housing 102. If bucket 224 is used, it may be removed in conjunction with the removal of sealed bag 25 to facilitate removing sealed bag 25 from housing interior space 104.

Another empty bag 10 may then be installed in mail collection box 100 in the manner discussed above, and chute 128 and bag 10 may again be positioned in mail deposit mode 168 forming mail deposit pathway 172. Deposit door 120 may then be locked in the deposit door closed position 124. Bucket 224 may be returned to rest on tray 220 within housing interior space 104. Access door 110 may then be locked in the door closed position 116.

If sealed bag 25 comprises filter patch 66 covering outlet port 68, then a portion of the air within the sealed bag may be expelled through the outlet port and filter patch when the sealed bag is compressed, for example, by the weight of other bags when several sealed bags are stacked upon each other in a truck. As a result, the air within the sealed bag will not be trapped inside the bag to increase the internal pressure within the bag, but rather air can escape so that the pressure within the bag will remain essentially equalized with the air pressure outside of the bag. In this sense, the outlet port 68 and filter patch 66 may act as a pressure relief valve to help reduce the chance that compressed air within the sealed bag may burst the bag. A conventional one-way valve may be used in conjunction with the outlet port and filter patch to preclude the expelled air from returning into the bag and thus to help maintain the bag in a relatively compressed state.

If sealed bag 25 comprises filter patch 66, a one-way valve (not shown), or a hose coupling (not shown) covering outlet port 68, then a vacuum hose (not shown) may be engaged against bag 10 (i.e., against the filter patch, the one-way valve, or the hose coupling) to withdraw at least a portion of the air within the bag interior, for example, to help collapse the bag about the collected mail and reduce the volume of the sealed bag containing the collected mail. After withdrawal of the air, the one-way valve may preclude the re-entry of air into the bag. A resealing patch (discussed above) may be sealed over the outlet port 68 to reduce or prevent ambient air from returning to the interior of the bag, and thus help maintain the sealed bag in a collapsed state of reduced volume. The air withdrawn from the interior of the bag may be sampled or passed through an external filter (e.g., HEPA filter) to determine whether undesirable particulate matter (e.g., anthrax spores) are present, thus indicating whether the collected mail within the sealed bag had been exposed to biocontaminants or other undesirable agents. Further, after withdrawal of air through the filter medium 72, the filter medium may be removed from the bag before the resealing patch is applied over the outlet port. The exposed filter patch may be stored separately and/or subsequently analyzed to determine whether it has entrapped airborne particles indicating that the collected mail has been exposed to biocontaminants or other undesirable agents.

If sealed bag 25 includes a lower chamber 28 separated from the upper chamber 26 by strainer 42, then mail that falls into the upper chamber interior volume 34 is precluded by strainer 42 from entering lower chamber interior volume 36. However, any powder or other suspicious material that is small enough to fall through strainer 42 may collect in lower chamber interior volume 36. The lower chamber may then be visually or otherwise inspected after removal of the bag from the mail collection box to determine whether such powder or suspicious material is present. The presence of such material may indicate an increased chance that the collected mail within the sealed bag has been exposed to biocontaminants or other undesirable agents.

If sealed bag 25 includes a specimen strip 74, then the specimen strip may be removed from lower chamber 28, for example, by tearing out access portion 80 to provide access to lower chamber volume interior volume 36. (FIGS. 22–23.) The bag may be reclosed by folding over corner 82 to engage adhesive strip 84. The exposed specimen strip may be stored separately and/or subsequently analyzed to determine whether it has entrapped airborne particles indicating that the collected mail has been exposed to biocontaminants or other undesirable agents.

The sealed bag 25 containing collected mail may be taken to a separate location for further processing. For example, before opening sealed bag 25, the bag and its collected mail may be exposed to a treatment to kill or inactivate anthrax spores that may be present, for example, by exposing the sealed bag to an effective amount of radiation to kill or inactivate anthrax spores that may be present.

To remove the collected mail from the sealed bag 25, the bag may be torn open to provide access to the bag interior space or so that the mail can be dumped out. This tearing may be facilitated by one or more easy open notches 76 (FIG. 24) or other lines of relative weakness formed in bag 10, for example, to cause an initiated tear to preferentially travel transversely across the bag.

To provide recorded information that may be helpful in tracing the location for deposit of contaminated mail in a collection box, the identification information (discussed above) associated with the collection box 100 and bag 10 may be scanned or otherwise recorded along with the date and place of collection of the bag. This data may be stored and/or linked by computer database, and used, for example, to later link or trace a contaminated or suspect mail collection bag 10 to a particular collection box (and vice versa). The identification information for a filter patch 66, filter medium 72, or specimen strip 74 may also be scanned or recorded and similarly linked to the identification information for the bag. If it turns out, for example, that later random testing of the filters or specimen strips indicates that undesirable contaminants are present for a particular specimen, then it may be linked to its source sealed bag by the recorded information.

Further, mail contained in each sealed bag may be marked (e.g. printed) with common identification information when the mail is removed from the bag. This common identification information may also be associated or linked with the bag identification information by computer database. Each piece of mail that was once collected together in a single bag 10 may then be later identified by the common identification information on the mail. For example, then, if a contaminated or suspect piece of mail is later identified by its identification information, it may be linked or traced to the identification information for a particular bag and/or collection box, which in turn may be linked or traced to other mail that was commonly collected with the contaminated mail. Further, the public may be made aware of the common identification information to help the public identify and avoid mail that may have been cross-contaminated by common collection with a contaminated piece of mail.

The above descriptions are those of preferred embodiments of the invention. Various alterations and changes can be made without departing from the spirit and broader aspects of the invention as defined in the claims, which are to be interpreted in accordance with the principles of patent law, including the doctrine of equivalents. Except in the claims and the specific examples, or where otherwise expressly indicated, all numerical quantities in this description indicating amounts of material, use conditions, measurements, and the like, are to be understood as modified by the word "about" in describing the broadest scope of the invention. Any reference to an item in the disclosure or to an element in the claim in the singular using the articles "a," "an," "the," or "said" is not to be construed as limiting the item or element to the singular unless expressly so stated. All references to ASTM tests are to the most recent, currently approved, and published version of the ASTM test identified, as of the priority filing date of this application. Each such published ASTM test method is incorporated herein in its entirety by this reference.

What is claimed is:

1. A mail collection apparatus comprising:

a housing defining:

a housing interior space inside the housing;

a housing exterior space outside of the housing; and an access opening;

an access door supported by the housing and moveable between a door open position providing access to the housing interior space through the access opening and a door closed position blocking the access opening;

a chute supported by the housing, the chute comprising an inlet end defining a chute inlet opening adapted for receiving mail and a chute outlet end defining a chute outlet opening opposite the inlet end; and a bag defining a bag interior space and a bag exterior space and comprising an inlet portion defining a bag inlet opening, wherein:

the bag and chute are moveable relative each other between:

a mail deposit mode, in which the chute and the bag cooperate to form an enclosed mail deposit pathway from the chute inlet opening to the bag inlet opening and adapted so that mail deposited through the chute inlet opening falls along the mail deposit pathway through the chute outlet opening and the bag inlet opening into the bag interior space; and a mail collection mode, in which the chute and the bag are spaced apart from each other.

2. The apparatus of claim 1 wherein the bag is within the housing interior space in the mail deposit mode.

3. The apparatus of claim 1 wherein the bag and chute directly engage each other in the mail deposit mode.

4. The apparatus of claim 1 wherein in the mail deposit mode the inlet portion of the bag is sealingly engaged with the chute.

5. The apparatus of claim 1 wherein in the mail deposit mode the chute outlet end and the bag inlet end are engaged to form a seal between the chute and the bag, the seal being capable of preventing the passage of detectable amounts of 1 micron diameter airborne solid particles exposed to the seal in a 24 hour period at ambient conditions of 72° F. and atmospheric pressure of 14.7 psia.

6. The apparatus of claim 1 further comprising a sealing band wherein in the mail deposit mode the sealing band encircles the inlet portion of the bag and the outlet end of the inlet chute to sealingly engage the inlet portion of the bag with the chute.

7. The apparatus of claim 1 further comprising a sealing band moveable between:

a sealing position in which the sealing band encircles the inlet portion of the bag and the outlet end of the inlet chute to sealingly engage the inlet portion of the bag with the chute in the mail deposit mode; and a spaced position in which the sealing band is spaced apart from the bag.

8. The apparatus of claim 1 wherein in the mail deposit mode the bag inlet portion is supported by the chute.

9. The apparatus of claim 1 wherein:

the chute comprises one or more support members;

the bag defines one or more receiving openings in the inlet portion of the bag; and in the mail deposit mode the bag inlet portion is supported by the one or more support members inserted in the one or more receiving openings.

10. The apparatus of claim 1 wherein in the mail deposit mode the bag inlet portion is supported by the housing.

11. The apparatus of claim 1 wherein:

the housing comprises one or more support members;

the bag defines one or more receiving openings in the inlet portion of the bag; and in the mail deposit mode the bag inlet portion is supported by the one or more support members inserted in the one or more receiving openings.

12. The apparatus of claim 1 wherein the chute is unapertured between the chute inlet opening and the chute outlet opening.

13. The apparatus of claim 1 wherein the chute is moveably supported by the housing.

14. The apparatus of claim 1 wherein the chute is moveably supported by the housing and moveable between a chute down position, in which the chute outlet end is in the housing interior space and the chute and bag are in the mail deposit mode, and a chute up position, in which the chute outlet end is in the housing exterior space.

15. The apparatus of claim 1 further comprising a clamp supported by the housing, the clamp comprising front and rear opposing clamp members, wherein the clamp is adjustable between:

a clamp open mode in which the front and rear clamp members are spaced apart; and a clamp closed mode in which the front and rear clamp members are proximate each other and adapted to squeeze the bag between the front and rear clamp members.

16. The apparatus of claim 15 wherein:

in the clamp open mode the clamp defines an insertion zone between the front and rear clamp members; and in the mail deposit mode at least a portion of the bag is positioned in the insertion zone.

17. The apparatus of claim 16 wherein in the clamp closed mode the front and rear clamp members squeeze the bag to form a closed bag defining a closed bag volume comprising at least a portion of the bag interior space.

18. The apparatus of claim 17 wherein the closed bag is capable of retaining within the closed bag volume airborne particles having a diameter greater than 1 micron over a 24 hour period at ambient conditions of 72° F. and atmospheric pressure of 14.7 psia.

19. The apparatus of claim 15 wherein the clamp comprises a heat seal mechanism.

20. The apparatus of claim 19 wherein the front clamp member comprises a front heat seal bar and the rear clamp member comprises a rear heat seal bar.

21. The apparatus of claim 15 wherein the front and rear clamp members each comprise one or more rollers.

22. The apparatus of claim 15 wherein in the clamp closed mode the clamp is adapted to squeeze the bag between the front and rear clamp members with increasing force as an increasing force downward is applied to the bag.

23. A method of collecting mail comprising:

providing the mail collection apparatus of claim 15;

placing the bag and chute in the mail deposit mode and the clamp in the open mode, whereby mail may be deposited through the enclosed mail deposit pathway into the bag interior space;

subsequently placing the clamp in the closed mode to squeeze the bag closed;

subsequently placing the bag and chute in the mail collection mode;

subsequently sealing the bag closed;

subsequently placing the clamp in the clamp open mode;

subsequently removing the sealingly closed bag from the housing interior space; and subsequently installing an empty bag within the housing interior space and placing the empty bag and chute in the mail deposit mode.

24. The method of claim 23 further comprising:

withdrawing at least a portion of the air from the bag interior space to place the bag in a reduced volume state before placing the clamp in the closed mode to squeeze the bag closed; and sealing the bag closed while in the reduced volume state.

25. A method of collecting mail comprising:

providing the mail collection apparatus of claim 15;

placing the bag and chute in the mail deposit mode and the clamp in the open mode, whereby mail may be deposited through the enclosed mail deposit pathway into the bag interior space;

subsequently placing the clamp in the closed mode to squeeze the bag closed and to form a sealingly closed bag;

subsequently placing the bag and chute in the mail collection mode and the clamp in the clamp open mode;

subsequently removing the sealingly closed bag from the housing interior space; and subsequently installing an empty bag within the housing interior space and placing the empty bag and chute in the mail deposit mode.

26. The apparatus of claim 1 further comprising a chute door supported by a structure selected from the chute and the housing, wherein:

the chute door is moveable between a chute door open position, which allows access for mail to be deposited through the chute inlet opening, and a chute door closed position, in which the chute door blocks mail access to the chute inlet opening; and the chute door defines an evacuation port adapted to provide access for a vacuum source to withdraw at least a portion of the air from within the bag interior space when the chute door is in the door closed position and the bag and chute are in the mail deposit mode.

27. A method of collecting mail comprising:

providing the mail collection apparatus of claim 1;

placing the bag and chute in the mail deposit mode, whereby mail may be deposited through the enclosed mail deposit pathway into the bag interior space;

subsequently placing the bag and chute in the mail collection mode; and subsequently sealing the bag closed.

28. The method of claim 27 further comprising:

withdrawing at least a portion of the air from the bag interior space to place the bag in a reduced volume state; and a sealing the bag closed while in the reduced volume state.

29. The method of claim 27 further comprising withdrawing at least a portion of the air from the bag interior space after sealing the bag closed.

* * * * *

UNITED STATES PATENT AND TRADEMARK OFFICE

CERTIFICATE OF CORRECTION

PATENT NO. : 6,742,703 B2
DATED : May 31, 2002
INVENTOR(S) : Esakov et al.

It is certified that error appears in the above-identified patent and that said Letters Patent is hereby corrected as shown below:

Column 18,
Line 15, “a sealing” should be -- sealing --.

Signed and Sealed this

Fourth Day of January, 2005

JON W. DUDAS
*Director of the United States Patent and Trademark Office*